US008789857B2

(12) United States Patent
Liang et al.

(10) Patent No.: US 8,789,857 B2
(45) **Date of Patent: *Jul. 29, 2014**

(54) FORCE ENTRY RESISTANT SASH LOCK

(75) Inventors: Luke Liang, Plainfield, NJ (US); Tong Liang, Guang Zhou (CN); David Chen, Guang Zhou (CN)

(73) Assignee: Vision Industries Group, Inc., So. Plainfield, NJ (US)

( * ) Notice: Subject to any disclaimer, the term of this patent is extended or adjusted under 35 U.S.C. 154(b) by 53 days.

This patent is subject to a terminal disclaimer.

(21) Appl. No.: 13/491,699

(22) Filed: Jun. 8, 2012

(65) Prior Publication Data

US 2012/0313387 A1 Dec. 13, 2012

Related U.S. Application Data

(60) Provisional application No. 61/520,623, filed on Jun. 10, 2011, provisional application No. 61/555,622, filed on Nov. 4, 2011.

(51) Int. Cl.
*E05C 19/12* (2006.01)
*E05C 3/02* (2006.01)

(52) U.S. Cl.
USPC .... 292/111; 292/240; 292/242; 292/DIG. 20; 292/DIG. 47; 70/89; 70/90; 49/449

(58) Field of Classification Search
USPC ..... 292/14, 17, 19, 65, 70, 76, 80, 83, 98, 292/108, 111, 124, 197, 210, 240–242, 292/DIG. 20, DIG. 47, DIG. 61, DIG. 62; 70/89, 90; 49/449
See application file for complete search history.

(56) References Cited

U.S. PATENT DOCUMENTS

| | | | | | |
|---|---|---|---|---|---|
| 314,350 | A | * | 3/1885 | Smith | 292/65 |
| 359,058 | A | * | 3/1887 | Chantrell | 292/111 |
| 368,240 | A | * | 8/1887 | Rippien | 292/111 |
| 370,560 | A | * | 9/1887 | Rippien | 292/111 |
| 379,124 | A | * | 3/1888 | Paul | 292/210 |
| 398,549 | A | * | 2/1889 | Smith | 292/111 |
| 403,391 | A | * | 5/1889 | Smith | 292/111 |
| 438,337 | A | * | 10/1890 | Wolcott | 292/111 |
| 501,238 | A | * | 7/1893 | Wolcott | 292/111 |
| 520,754 | A | * | 5/1894 | Burmeister | 292/65 |
| 527,686 | A | * | 10/1894 | Hasenpflug | 292/111 |
| 528,369 | A | * | 10/1894 | Hasenpflug | 292/111 |
| 1,370,109 | A | * | 3/1921 | Hart | 292/239 |

(Continued)

*Primary Examiner* — Carlos Lugo
*Assistant Examiner* — Alyson M Merlino
(74) *Attorney, Agent, or Firm* — Thomas A. O'Rourke; Bodner & O'Rourke, LLP

(57) ABSTRACT

An improved forced entry resistant sash lock comprises a housing, a shaft rotatably mounted thereto, a locking spring, and a locking cam and a delay cam rotatably and fixedly mounted to the shaft, respectively. The delay cam selectively engages and drives the locking cam between a locked position and an unlocked position. Locking spring biasing causes engagement with a locking cam opening to lock the cam when in the latch-locked position, with engagement to a depth permitting releasable detent engagement in a delay cam recess. Selective engagement and driving of the locking cam comprises a first portion of delay cam rotation being without driven locking cam rotation, and a second portion causing driven locking cam rotation from a retracted position into a protruding position. Selective engagement is by contact between corresponding protrusions on the delay and locking cams. Shaft/delay cam counter-rotation to unlock the latch proceeds in a reverse manner.

22 Claims, 22 Drawing Sheets

(56) References Cited

U.S. PATENT DOCUMENTS

| | | | | |
|---|---|---|---|---|
| 3,762,750 | A * | 10/1973 | Orr | 292/140 |
| 4,261,602 | A * | 4/1981 | Anderson | 292/143 |
| 5,110,165 | A * | 5/1992 | Piltingsrud | 292/242 |
| 6,871,886 | B2 * | 3/2005 | Coleman et al. | 292/241 |
| 7,159,908 | B2 * | 1/2007 | Liang | 292/242 |
| 7,322,620 | B1 * | 1/2008 | Lawrence | 292/242 |
| 8,336,930 | B2 * | 12/2012 | Liang et al. | 292/242 |
| 2007/0085350 | A1 * | 4/2007 | Liang et al. | 292/240 |
| 2007/0158953 | A1 | 7/2007 | Liang | |
| 2010/0192643 | A1 * | 8/2010 | Liang et al. | 70/90 |
| 2011/0304163 | A1 * | 12/2011 | Liang et al. | 292/242 |
| 2012/0313386 | A1 * | 12/2012 | Liang et al. | 292/224 |

* cited by examiner 60
62
64
65
65E2
66
66E1
67
68
69

66E2
65E1
65E2

63
62
67

63
64
64Ri
64Rii
64T
60

30
31
32
33
34
35
36
36C
37
38
38C
39

30
39

44
47
47S1
47S2
41
46
46S1
46S2
48
49

46

44
43
42
45

43G
43W
45Dsii
45Dsi
43

40
45Dii
45Dsii
45Di
45A
45B
45C 41
47
48
50
50E1
50E2
51
51E1
51E2
46

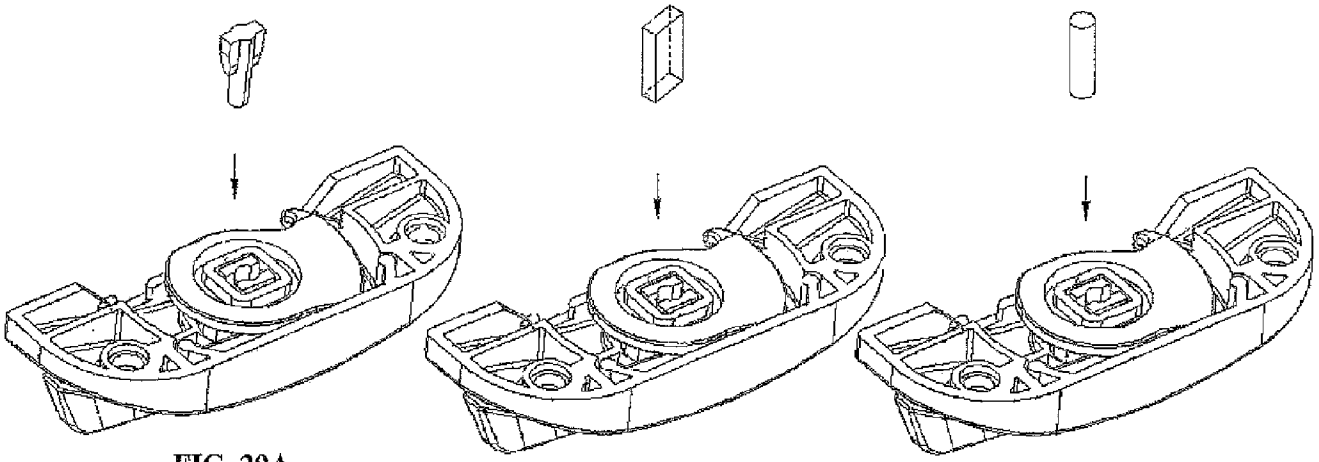
FIG. 29A
FIG. 29B
FIG. 29C
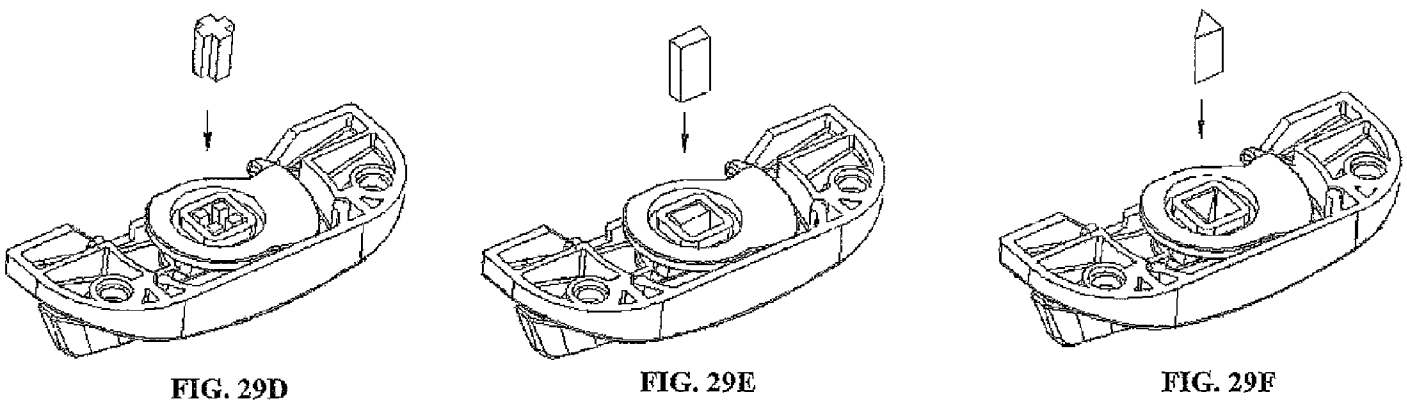
FIG. 29D
FIG. 29E
FIG. 29F

FORCE ENTRY RESISTANT SASH LOCK

CROSS REFERENCES TO RELATED APPLICATIONS

This application claims priority on U.S. Provisional Application Ser. No. 61/520,623 filed on Jun. 10, 2011, and on U.S. Provisional Application Ser. No. 61/555,622 filed on Nov. 4, 2011, with the disclosures of each being incorporated herein by reference.

FIELD OF THE INVENTION

The present invention is directed to the field of window locks, and more particularly sash locks. The sash lock of the present invention is more resistant to forced entry than traditional locks.

BACKGROUND OF THE INVENTION

Sliding windows, double hung windows, and single hung windows are three common types of windows known in the art. Sash locks frequently are used to secure the sash or sashes to prevent them from opening.

One type of sash lock that has recently been marketed is known as a forced-entry resistant (FER) lock. The testing for forced entry resistant locks may be found, for example, in a standard promulgated by ASTM International (formerly the American Society for Testing and Materials), which is F588-04, "Standard Test Method for Measuring the Forced Entry Resistance of Window Assemblies, Excluding Glazing Impact."

Examples of forced entry resistant sash locks are shown in: U.S. application Ser. No. 12/587,377, filed Oct. 6, 2009; U.S. application Ser. No. 11/649,729, filed Jan. 4, 2007; and U.S. Pat. No. 7,159,908, the disclosures of which are incorporated herein by reference.

SUMMARY OF THE INVENTION

A window lock may comprise a housing, a shaft being rotatably mounted in a housing orifice, a locking cam being rotatably mounted upon the shaft within a cavity of the housing, a delay cam being fixedly mounted to the shaft, and a locking spring being installed in the housing cavity. A portion of the delay cam may be received within a portion of the locking cam to thereby selectively engage and drive the locking cam between a first position in which the sash lock is unlocked, and a second position in which the sash lock is locked. The locking spring may have a first end secured to the housing such that its second end is biased into contact with the locking cam. The biased locking spring may engage a first opening in the locking cam to lock the locking cam relative to the housing upon the locking cam reaching the second (locked) position. The engagement of the second end of the locking spring within the locking cam may be to a depth sufficient to further permit engagement of the second end of the spring therein with a first chamfered recess in the delay cam to thereby serve as a detent to releasably retain the delay cam and shaft in the second position.

The delay cam selectively engaging and driving the locking cam may comprise, upon rotation of the shaft and delay cam from the first position to the second position, a first portion of the rotation of the delay cam being without driven rotation of the locking cam; and a second portion of the rotation of the delay cam causing rotation of the locking cam to thereby drive the locking earn from an retracted position being within the housing, into an extended position being with a portion of the locking cam protruding out from the housing cavity. The second portion of the rotation of the delay cam causing driven rotation of the locking cam may be by a protrusion on the delay cam being positioned thereon to engage a corresponding protrusion on the locking cam, after the first portion of the shaft/delay cam rotation has occurred. The first portion of the rotation of the delay cam may be for approximately 72 degrees of rotation, where the first and second portions of rotation of the delay earn may together comprises approximately 180 degrees of rotation. The locking cam rotation between the retracted and the extended positions may comprise approximately 90 degrees of rotation.

The delay cam selectively engaging and driving the locking cam may further comprise, upon counter-rotation of the shaft and delay cam from the second position to the first position: a first portion of the counter-rotation of the delay cam being without driven counter-rotation of the locking cam, and second portion being with driven counter-rotation. The first portion of the delay cam counter-rotation may initially be with the first chamfered recess counter-rotating to cause partial disengagement of the locking spring second end from the locking cam first opening, with the partial disengagement resulting in an angled surface of the locking spring contacting an edge of the locking cam first opening to serve as a detent. The second portion of the counter-rotation of the delay cam may cause counter-rotation of the locking cam and complete disengagement of the locking spring from the edge of the locking cam, to thereby drive the locking cam from the extended position into the retracted position. The second portion of the counter-rotation of the delay cam causing driven counter-rotation of the locking cam may be by a second protrusion on the delay cam being positioned thereon to engage a second protrusion on the locking cam, after the first portion of the corresponding shaft/delay cam counter-rotation has occurred.

The locking cam may further comprise a second opening to receive the locking spring second end to form a detent, so that when the locking cam is driven into the retracted position, the biased second end of the locking spring may engage the second opening in the locking cam. The second opening may be chamfered to permit the locking spring second end to be releasable therefrom upon rotation of the shaft. Also, the delay cam may further comprise a second recess, so that when the locking cam is driven into the retracted position, the biased second end of the locking spring may engage the second opening in the locking cam to a depth to further permit engagement of the spring therein with the second recess of the delay cam. The second recess of the delay cam may also be chamfered to permit the locking spring second end to be releasable therefrom upon rotation of the shaft.

BRIEF DESCRIPTION OF THE DRAWINGS

FIG. 29A-29F shows various shaped wedge members being used to slidably retain the delay cam within the locking cam.

DETAILED DESCRIPTION OF THE INVENTION

Figure 1B:
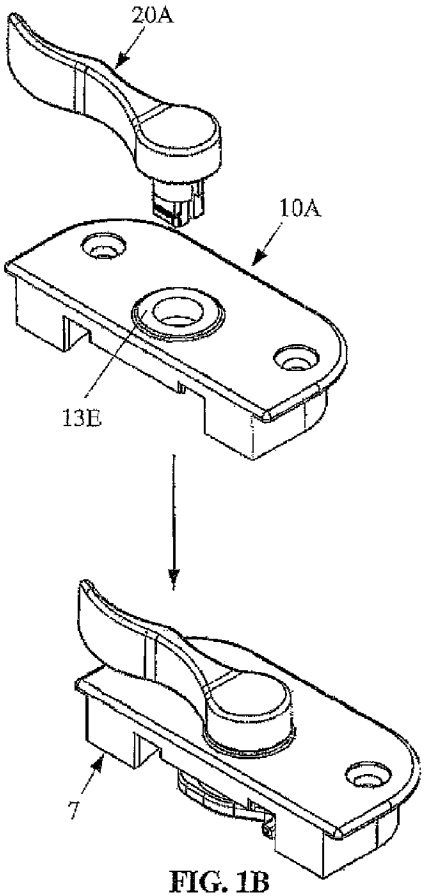
FIG. 1B shows an alternate assembled view that may be created using an alternate housing and a different shaped graspable handle extending from the shaft.
Figure 1:
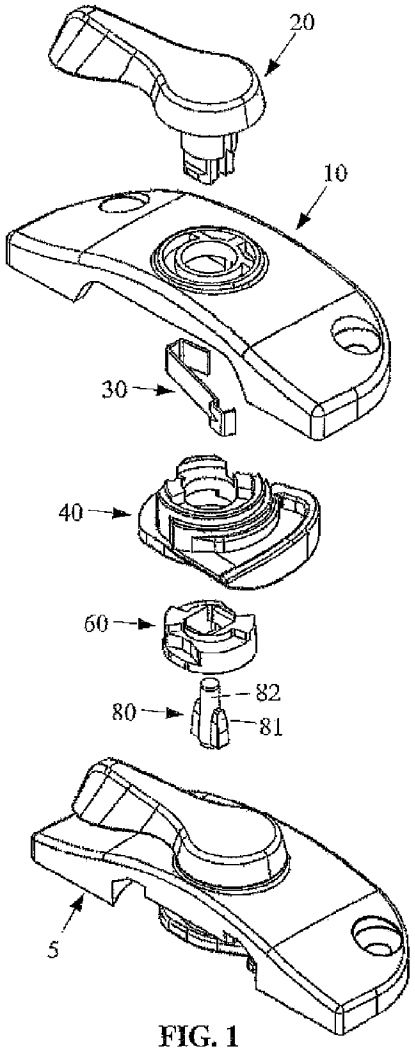
FIG. 1 is an assembled view and an exploded view of the parts comprising a first embodiment of the force resistant lock of the present invention.
Figure 1A:
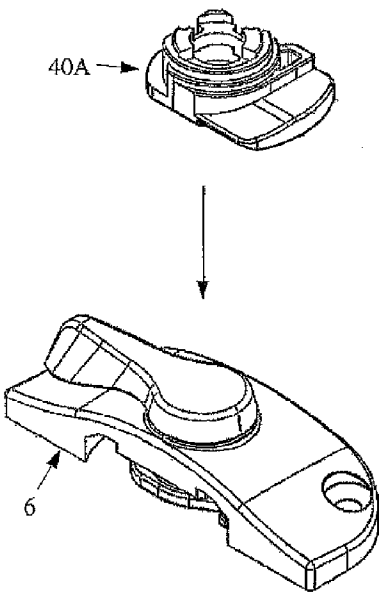
FIG. 1A shows an alternate assembled view that may be created using an alternate locking cam.

FIG. 1 shows a first embodiment of the improved force entry resistance sash lock 5 of the present invention, which comprises a housing 10, a shaft/handle member 20, a locking spring 30, a locking cam 40, a delay cam 60, and a wedge member 80. As may be seen in FIG. 1A, an alternate embodiment may be formed by using a modified locking cam 40A to create lock 6 (being is a "sweep" lock that does not need to work with keeper), while another alternate embodiment shown in FIG. 1B may be formed by using a modified housing 10A along with a modified shaft/handle 20A to create lock 7. The locks 5, 6, or 7 may be secured to one sash member, and through its engagement with a keeper that is secured to another sash member or another part of the window, the lock (5, 6, or 7) may render the slidable sash member immobile, and thereby prevent unauthorized entry into a dwelling. An additional feature of the lock disclosed herein is its capability to generally resist a forced entry, which is accomplished, in addition to the locking of the sash, by securing of the locking cam that engages the keeper, so that attempts to simply slide a lock-picking device between the sashes to forcibly counter-rotate the locking cam will be unsuccessful. Also, another feature disclosed hereinafter, whereby the shaft/handle member 20 must necessarily rotate approximately 72 degrees before it begins to cause the delay cam to drive the locking cam from the locked position, further serves to resist a forced entry.

The housing 10, as well as the other component parts of the lock, may be formed of a metallic material through a machining, a forging, or a casting process, or may be made of a plastic material formed through an injection molding process, or it may be a laid-up composite part. The housing 10 may be formed to have only a single housing wall with an interior surface 12 and an exterior surface 11 (FIG. 7), and may additionally have a boss 13E protruding upward from the exterior surface 11 (FIG. 1B), along with one or more bosses 13I protruding downward from the interior surface 12 (FIG. 7), and with an orifice 15 being centered thereon. The one or more bosses 13I may protrude down from the interior surface 12 to produce a multi-faceted mounting surface proximate to orifice 15, for receiving the locking cam, as discussed hereinafter. Integral stiffeners 13S on the bottom may also surround the mounting orifices 14, which may be recessed/spot-faced/countersunk (FIG. 1) on the exterior to permit use of a flush fastener or to prevent the head of a protruding head fastener from protruding above the exterior surface 11 after installation of the lock upon the window sash. Also, the stiffeners on the bottom may nonetheless result in a cavity below the orifice 15 to permit installation of the cams 40 and 60, as described hereinafter.

The locking spring 30 (FIGS. 3 and 3A) may comprise a flexible leaf-spring-type member having a first end 31 and second end 32, and having a generally straight portion 33 that may bend proximate to the first end 31 to form a short section 34 that terminates in another bent portion 35. The portions 33, 34, and 35 may generally form a hook shape for installing the locking spring member 30 within housing 10. Part-way between the first end 31 and the second end 32, the generally straight portion 33 may transition into a series of turns to form a generally rectangular (or slightly trapezoidal) shape, and which may include a first leg 36, a connector 37, and a second leg 38 that terminates at the second end 32. First leg 36 may have a small straight ("chamfered") transition 36C into connector 37, and similarly connector 37 have a small straight ("chamfered") transition 38C into second leg 38. Instead of forming chamfers, the transitions 36C and 38C may instead be small rounded corners. A V-shaped deformation 39 in first leg 36 and connector 37 may serve to stiffen the series of turns, particularly first leg 36 and connector 37, so that flexing of the spring member 30 during operation of the lock, mostly occurs by elastic deformation of the long straight portion 33, as seen hereinafter. The first leg 36 and second leg 38 may be generally parallel to each other or nearly so, in order to permit engagement of those series of turns with the first opening 46 in the cylindrical portion 45 of the locking cam 40 to inhibit rotation of the cam, when the lock is in the locked position.

The locking spring 30 may be made of a flexible metallic material to produce a desired amount of biasing. (Note that an alternative to the cantilevered locking spring 30 may be the biasing member 30A seen in FIGS. 27A-27D, which may be supported by the housing at each end of that member, while another alternative may be the biasing member 30B shown in FIG. 28A-28D, which may be biased, using a helical spring 30S, out from a recess in the housing or out from a separate member that is attached to the housing cavity).

Figure 2:
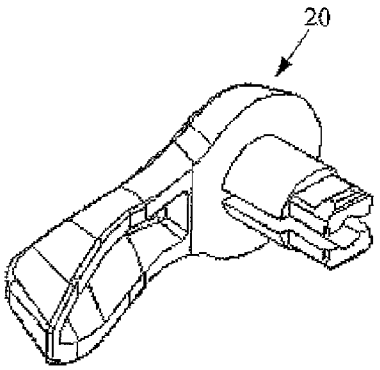
FIG. 2 is a perspective view of the shaft with graspable handle for the current invention.
Figure 2A:
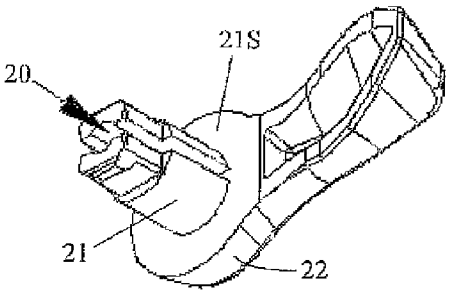
FIG. 2A is a reverse perspective view of the shaft with graspable handle of FIG. 2.
Figure 2C:
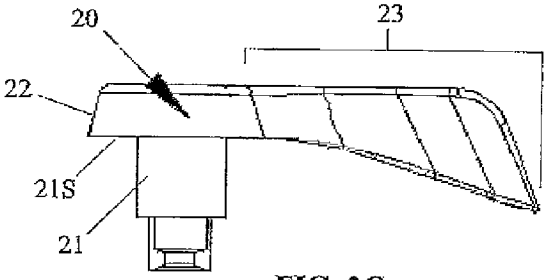
FIG. 2C is a side view of the shaft with graspable handle of FIG. 2.
Figure 2B:
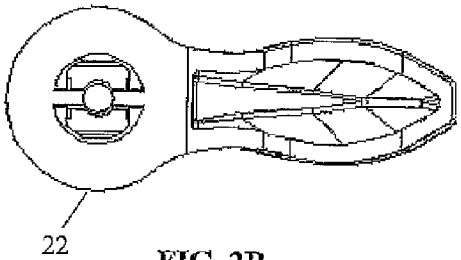
FIG. 2B is a bottom view of the shaft with graspable handle of FIG. 2.

The shaft 20 (FIG. 2) may comprise one or more different cylindrical sections having different diameters. Shaft 20 may have a first cylindrical section 21 (FIG. 2) with a diameter sized to be rotatably/pivotally received within orifice 15 of the housing 10. A second larger diameter cylinder may be used to create a shoulder 21S that may contact boss 13E to limit the depth of travel of the cylinder 21 into the housing orifice 15. The second cylinder may alternatively be a pan shaped member 22 (see FIG. 2D) that limits the travel. The second cylinder or pan-shaped member 22 may be large enough to be grasped by the fingers of a user, and may also be knurled to further assist in such grasping, for the purpose of actuating the lock, or alternatively, it may have a knob attached thereto. The pan-shaped member 22 may also have a handle-portion 23 extending laterally therefrom, as seen in FIG. 2C, to provide an easy means of applying a torque to the cylinder 21 to assist in causing rotation of the shaft 20. The handle-portion 23 may be mechanically secured to the pan-shaped member 22, or may be integrally formed therewith. Extending downward from the cylinder 21 may be a protrusion 24 having a rectangular cross-section that may have an opening 25 therein to create prongs 26 and 27, which may exhibit some degree of flexibility. Extending from the outward facing side (side opposite opening 25) of prongs 26 and 27 may be a respective lip 26L and 27L.

The locking cam 40 (FIG. 5C) may have a thickness 42 forming a top surface 43 and bottom surface 44. An orifice 41 may transverse the locking cam 40 between the top surface 43 and bottom surface 44, and a groove 43G (FIG. 5A) may be cut through a protruding portion of thickness 42 to create a curved, upstanding wall 43W. Wall 43W of locking cam 40 may be used to engage a corresponding key on a keeper to lock a sash, upon which the lock (5, 6, or 7) is mechanically fastened, using housing orifices 14. A cylindrical portion 45 may be concentric with orifice 41. Cylindrical portion 45 may be formed to comprise a series of telescoping cylindrical sections 45A, 45B, and 45C, which may play a role in the installation of the locking cam 40, as discussed hereinafter. Protruding upward from telescoping cylindrical section 45C may be a cylindrical section, which may be split to form two separate hollowed cylindrical protrusions 45$D_i$ and 45$D_{ii}$.

The cylindrical portion 45 may have a first opening 46 (FIG. 5B) cut at a position opposite to (positioned approximately 180 degrees away from) the center of the curved wall 43W, and may have a second opening 47 cut at a position clocked midway between the first opening and the center of the wall 43W (i.e., positioned 90 degrees away from the wall). Rotational positioning of the first opening 46 to be approximately 90 degrees from the second opening 47 creates "locked" and "unlocked" positions for the locking cam 40 of the lock (5, 6, or 7), also being 90 degrees apart, as discussed hereinafter with respect to the locking spring 30.

The first opening 46 may be generally trapezoidal-shaped, or may be rectangular-shaped, or may preferably be more square-shaped, having sides 46S1 and 46S2, to closely correspond to the portion of the locking spring 30 having the series of turns formed by first leg 36, connector 37, and second leg 38. The second opening 47 may have sides 47S1 and 47S2 that may preferably form a trapezoidal-shaped opening, as this trapezoidal opening may optionally be added to serve as a detent, to releasable restrain rotation of the locking cam 40 when the lock is in the unlocked position and the delay cam is initially rotated by the handle, as seen hereinafter.

The bottom surface 44 of locking cam 40 may have an orifice 48 (FIG. 5) therein, with it being concentric to, and of a slightly smaller diameter than, the cylinder 45. The first opening 46 and a second opening 47 may each be of sufficient depth so as to have at least a portion penetrate to the orifice 48. The orifice 48 may terminate in a flat bottom/end surface 49 that may generally be parallel to top surface 43. Protruding downward from the end surface 49 may be one or two or four or even more discrete protrusions, which may be integrally formed with, or be mechanically fastened to, the end surface 49. In one embodiment (FIG. 5), a protrusion 50 may protrude down from end surface 49 on one side of the orifice 41 to create an engagement surface 50E1, and a second protrusion 51 may also protrude down from end surface 49 on an opposite side of orifice 41 to create an engagement surface 51E1.

This pair of engagement surface (50E1 and 51E1) of protrusions 50 and 51 may be selectively engaged by the delay cam 60 to drive the locking cam 40 to rotate from a first position, in which the lock (5, 6, or 7) is unlocked and with the locking cam 40 being retracted within the housing cavity, to a second position, in which the lock is locked and being with a portion of the locking cam 40 protruding out from the housing 10. Protrusions 50 and 51 may furthermore be formed to additionally create respective engagement surfaces 50E2 and 51E2, which may also be selectively engaged by the delay cam 60 to drive the locking cam 40 to counter-rotate from the second position back to the first position.

While only two protrusions were used in this embodiment, it may be understood that four separate protrusions may alternatively be used to create the four engagement surfaces, whose functioning will be discussed later in more detail. Also, the protrusions need not create flat engagement surfaces—the protrusions may also be cylindrical, or may be any other shape that is practical for driving the locking cam to rotate. Additionally, while a pair of opposingly positioned protrusions was cited in this embodiment to be used for driving rotation of the locking cam, it may be seen that only one protrusion may be used to either drive the locking cam's rotation or counter-rotation, although this may also result in the creation of bearing forces, rather than just a torsional forces to cause rotation/counter-rotation.

Figure 2D:
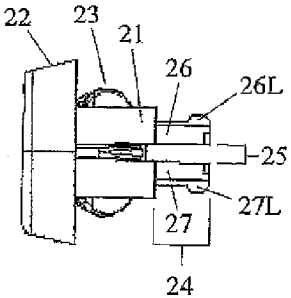
FIG. 2D is an end view of the shaft with graspable handle of FIG. 2.

The delay cam 60 (FIGS. 4 and 4A-4C) may comprise a cylinder 61 with top and bottom surfaces 62 and 63. The diameter of cylinder 61 may be sized to be able to provide a clearance fit with the diameter of orifice 48 of the locking cam 40. The delay cam 60 may have a rectangular opening 64 formed between surfaces 62 and 63, and which may correspond to the rectangular protrusion 24 of shaft 20 (FIG. 2D). Protruding upward from the top surface 63 may be one or two or four or even more discrete protrusions, which may correspond to the protrusions used on the locking cam 40. In an embodiment of the delay cam 60 being usable with the embodiment of the locking cam 40 described above (two protrusions 50 and 51 creating engagement surfaces 50E1, 51E1, 50E2, and 51E2), a first protrusion 65 protruding up from top surface 62 may create engagement surfaces 65E1 and 65E2, while a second protrusion 66 also protruding up from top surface 62, but on an opposite side of the surface, may create engagement surfaces 66E1, and 66E2. Both protrusions 65 and 66 may terminate in a flat upper surface 67 that may be generally parallel to top surface 62. The delay cam 60 may also have a first, wide V-shaped recess 68 in the side of the cylinder 61, and a second, wide V-shaped recess 69 being located in the side of the cylinder to be approximately 180 degrees from the first recess. The shape of the recesses 68 and 69 may permit their use as a detent, as discussed hereinafter.

Figures 3, 3A, 4, 4A, 4B, 4C, 5, 5A, 5B, 5C, 5D, 5E:
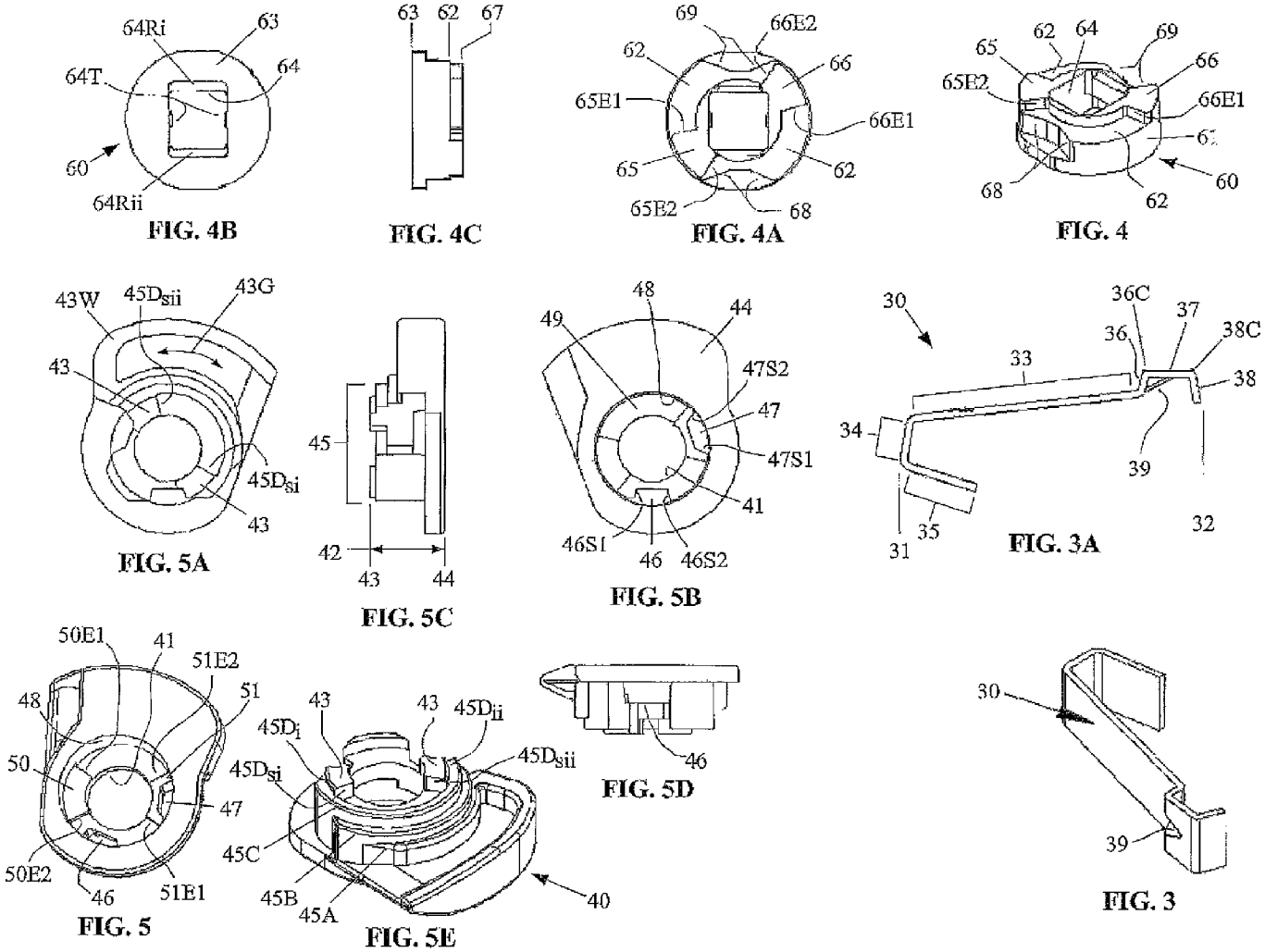
FIG. 3 is a perspective view of the locking spring member of the current invention.
FIG. 3A is a side view of the locking spring member of FIG. 3.
FIG. 4 is a perspective view of the delay cam of the present invention.
FIG. 4A is a top view of the delay cam of FIG. 4.
FIG. 4B is a bottom view of the delay cam of FIG. 4.
FIG. 4C is a side view of the delay cam of FIG. 4.
FIG. 5 is a perspective view of the locking cam of the present invention.
FIG. 5A is a top view of the locking cam of FIG. 5.
FIG. 5B is a bottom view of the locking cam of FIG. 5.
FIG. 5C is a side view of the locking cam of FIG. 5.
FIG. 5D is an end view of the locking cam of FIG. 5.
FIG. 5E is a reverse perspective view of the locking cam of FIG. 5.
Figure 6:
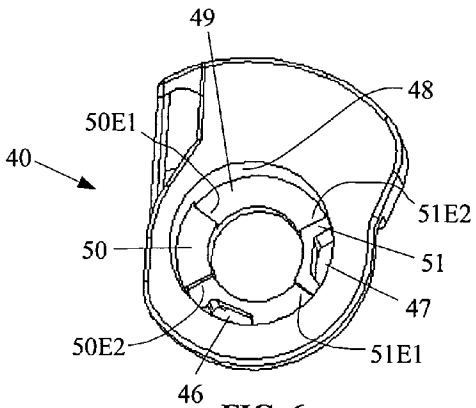
FIG. 6 is the perspective view of the locking cam of FIG. 5, shown enlarged.
Figure 6A:
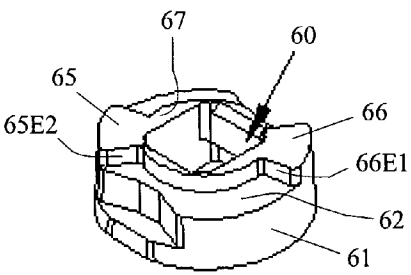
FIG. 6A is the perspective view of the delay cam of FIG. 4, shown enlarged.
Figure 6E:
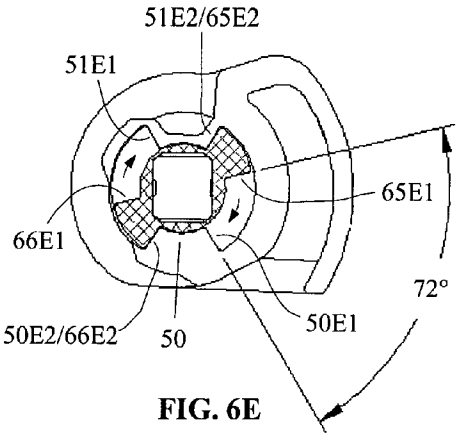
FIG. 6E is a cross-sectional view through the assembled delay cam-locking cam combination of FIG. 6C, taken to show the delay cam engagement protrusions relative to the locking cam protrusions.
Figure 6D:
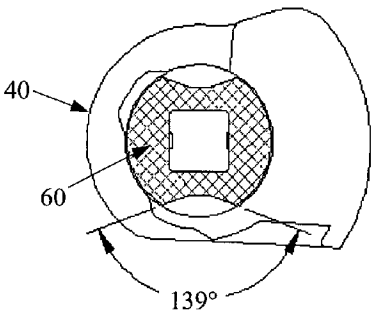
FIG. 6D is a cross-sectional view through the assembled delay cam-locking cam combination of FIG. 6C, taken to show the delay cam recesses relative to the locking cam.

Assembly of, and engagement between, locking cam 40 and delay cam 60 may be seen by viewing FIGS. 6-6E. The delay cam 60 may be inserted into the locking cam 40, with the cylinder 61 of the delay cam being received within the orifice 48 of the locking cam, such that the first and second protrusions 65 and 66 of the delay cam are positioned between the first and second protrusions 50 and 51 of the locking cam, with the flat upper surface 67 of the protrusions of the delay earn contacting the bottom/end surface 49 of the locking cam 40 (FIGS. 4C and 5B). Also, if the height that the protrusions 65 and 66 protrude above top surface 62 of the delay cam matches the height that the protrusions 50 and 51 protrude down from bottom/end surface 49 of the locking cam, then the bottom planar surface of the protrusions 50 and 51 may also simultaneously contact top surface 62 of the delay cam 60. This pairing arrangement of protrusions may permit the delay cam 60 to selectively engage and drive rotation and counter-rotation of the locking cam 40 between the first and second (locked and unlocked) positions.

Figure 6C:
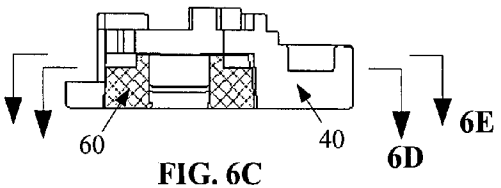
FIG. 6C is a cross-sectional view through the assembled delay cam-locking cam combination of FIG. 6B.
Figure 6B:
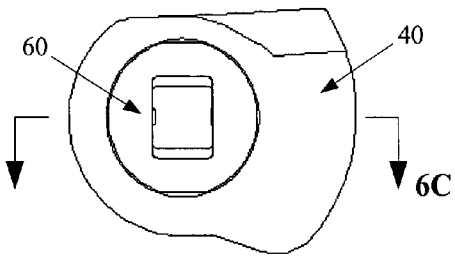
FIG. 6B is a bottom view showing the delay cam of FIG. 4B installed within the locking cam of FIG. 5B.

FIG. 6B shows the delay can 60 having been received and nested within the locking cam 40. A section cut through the combination of the locking cam 40 and delay cam 60 is shown in FIG. 6C, with the delay cam being shown with cross-hatching. A section cut therethrough is shown in FIG. 6E, and illustrates the relative positioning of the protrusions of the delay cam 60 with respect to the protrusions of the locking cam 40. Based on the relative positioning of the locking cam 40 and delay cam 60 in FIG. 6B (corresponding to the unlocked position), it may be seen in FIG. 6E that the engagement surface 51E2 of protrusion 50 will be contacting engagement surface 65E2 of protrusion 60, and also that engagement surface 50E2 of protrusion 50 will be contacting engagement surface 66E2 of protrusion 60. Additionally, it may be seen in FIG. 6E that with approximately 72 degrees of rotation of the locking cam 40 relative to the delay cam 60, that engagement surface 65E1 of protrusion 66 will engage the engagement surface 50E1 of protrusion 50, and also that that engagement surface 66E1 of protrusion 66 will engage the engagement surface 51E1 of protrusion 50. This engagement, after those 72 degrees of relative rotation, will cause the previously mentioned driving of the locking cam from the unlocked position to the locked position, as discussed hereinafter with regard to the overall lock assembly.

Figures 7, 7A, 8, 8A, 9, 9A, 10, 10A, 11, 11A, 11B, 11C, 11D:
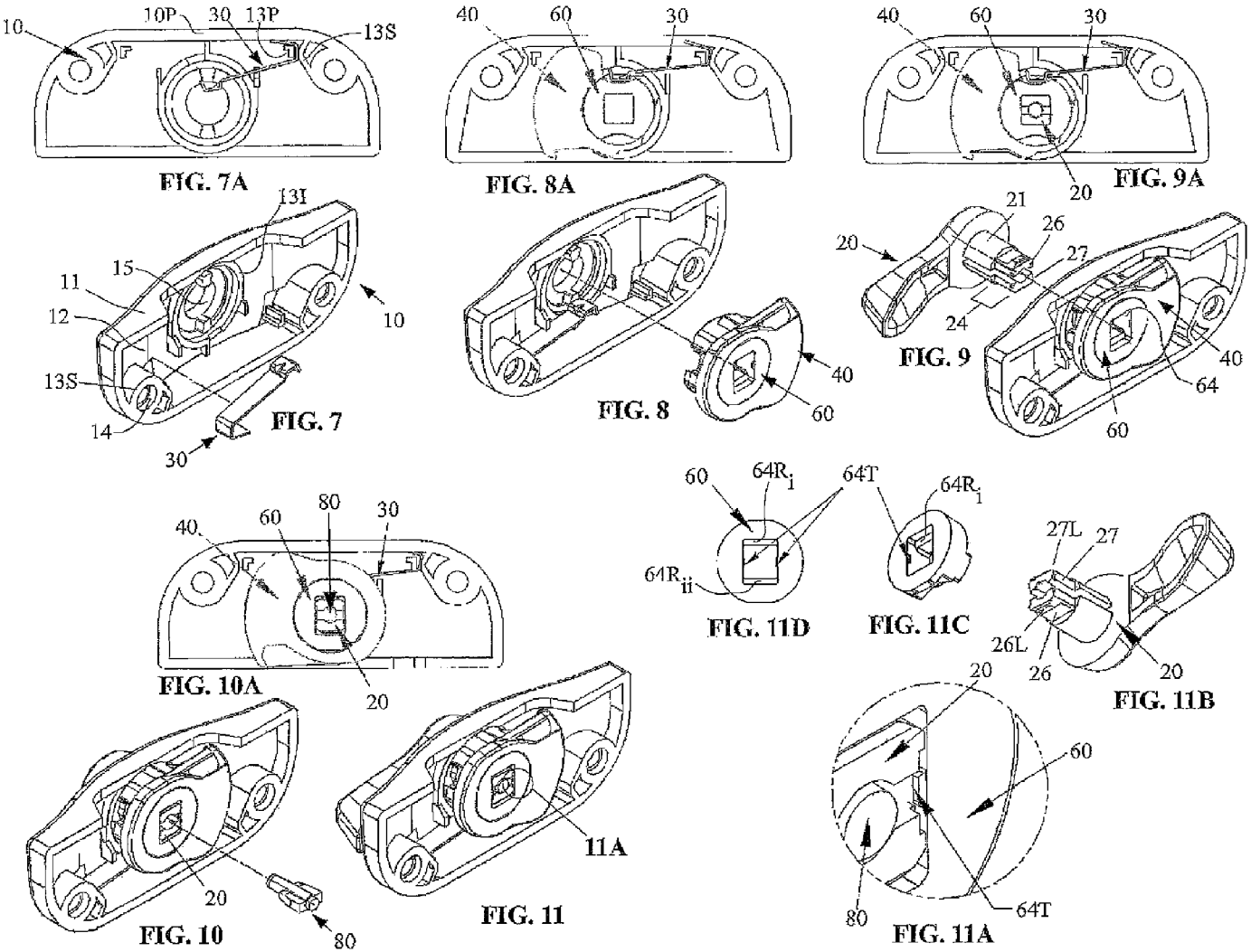
FIG. 7 is a perspective view of the housing of the force entry resistance lock of FIG. 1, shown with the locking spring member prior to its installation therein.
FIG. 7A is a bottom view of the housing of FIG. 7 with the locking spring member installed therein.
FIG. 8 is the perspective view of FIG. 7, shown with the locking spring member installed therein, but prior to installation therein of the locking cam-delay cam combination.
FIG. 8A is the bottom view of FIG. 7A, shown with the locking cam-delay cam combination installed therein.
FIG. 9 is the perspective view of FIG. 8, shown with the locking spring member and the locking cam-delay cam combination installed therein, but prior to installation of the shaft with graspable handle.
FIG. 9A is the bottom view of FIG. 8A, shown with the graspable handle installed therein.
FIG. 10 is the perspective view of FIG. 9, shown with the locking spring member, the locking cam-delay cam combination, and the shaft with graspable handle installed therein, but prior to installation of the wedge member.
FIG. 10A is the bottom view of FIG. 9A, shown with the wedge member also installed therein.
FIG. 11 is the perspective view of FIG. 10, shown with the locking spring member, the locking cam-delay cam combination, the shaft with graspable handle, and the wedge member installed therein.
FIG. 11A is the perspective view of FIG. 11 enlarged to show retention of the wedge member within the shaft using a protrusion on the delay cam.
FIG. 11B is the reverse perspective view of the shaft with graspable handle of FIG. 2A.
FIG. 11C is a reverse perspective view of the delay cam of FIG. 4.
FIG. 11D is the bottom view of FIG. 4B.

Overall assembly of the lock (5, 6, or 7) may be seen in FIGS. 7-11. FIG. 7 shows a perspective view of the housing 10 and of the locking spring 30 before it is secured in the housing. FIG. 7A shows a bottom view of the housing 10, and with the portions 33, 34, and 35 of locking spring 30 secured therein by being hooked about a post 13P that protrudes from the housing interior surface 12, and with the spring being maintained in this "hooked" position by additional contact with the adjacent wall 13S and a peripheral wall 10P of housing 10. Next, as seen in FIG. 8, the assembled combination of the locking cam 40 and delay cam 60 may be installed within the housing 10 to result in the assembly shown by the bottom view in FIG. 8A, where a portion of the locking cam is shown cut away to reveal the biased engagement of the locking spring 30 with the cams. The second end of the locking spring 30 may thus be normally biased into contact with at least a portion of the cylinder 45 of the locking cam 40.

Figure 12A:
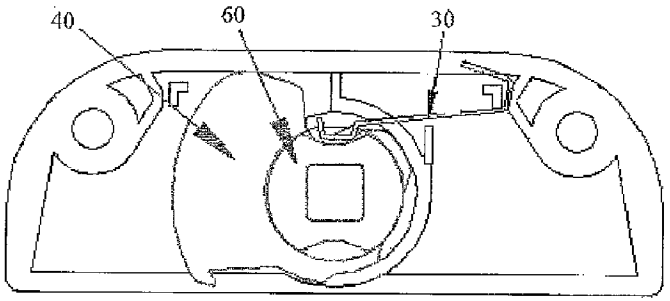
FIG. 12A is the view of FIG. 8A, shown enlarged.
Figure 12:
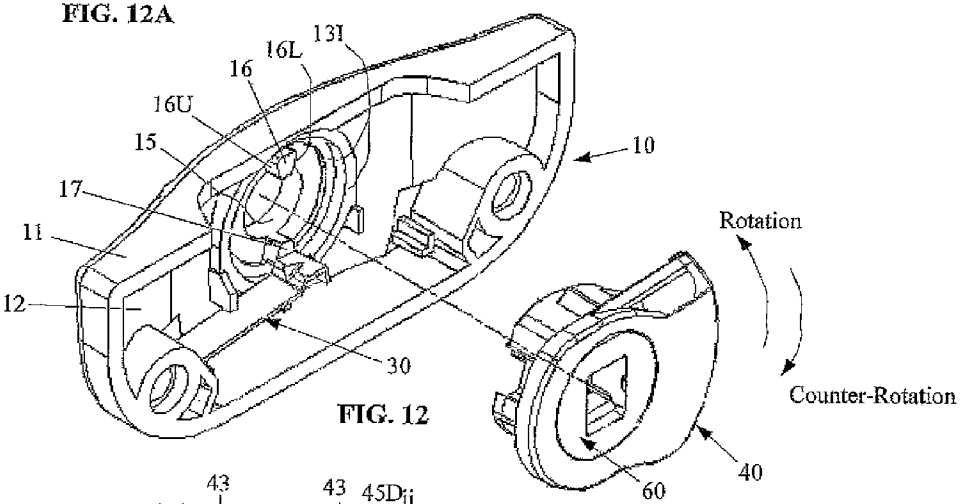
FIG. 12 is the view of FIG. 8, shown enlarged.
Figure 12B:
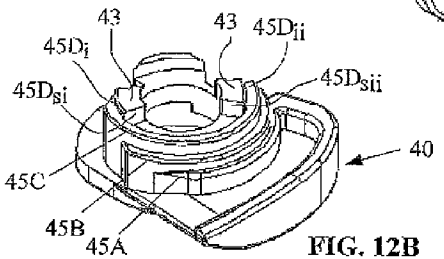
FIG. 12B is the view of FIG. 5E shown enlarged.
Figure 13A:
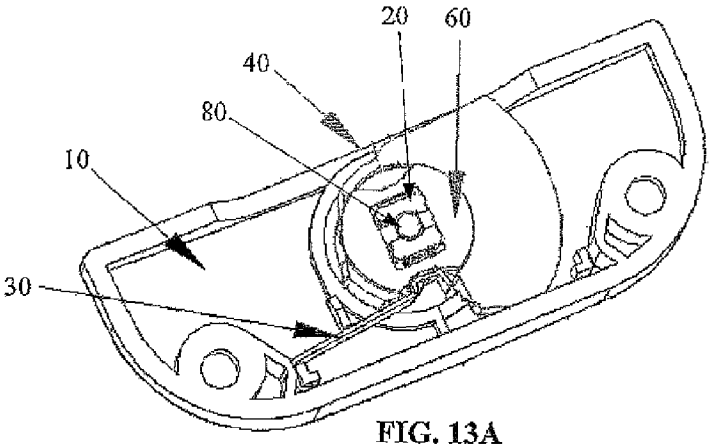
FIG. 13A is a bottom perspective view of the assembled lock of FIG. 13.
Figure 14A:
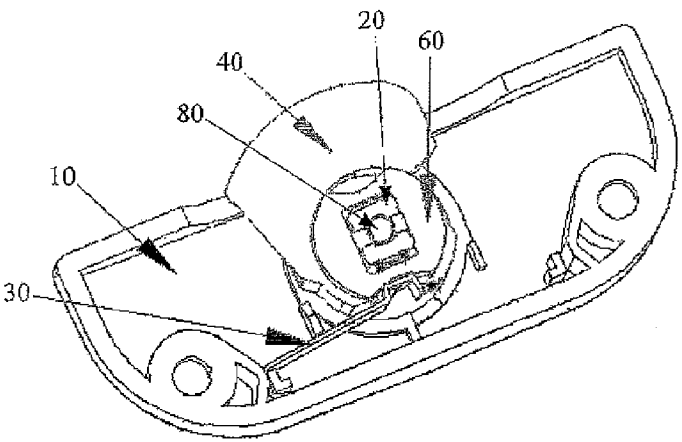
FIG. 14A is a bottom perspective view of the assembled lock of FIG. 14.
Figure 13:
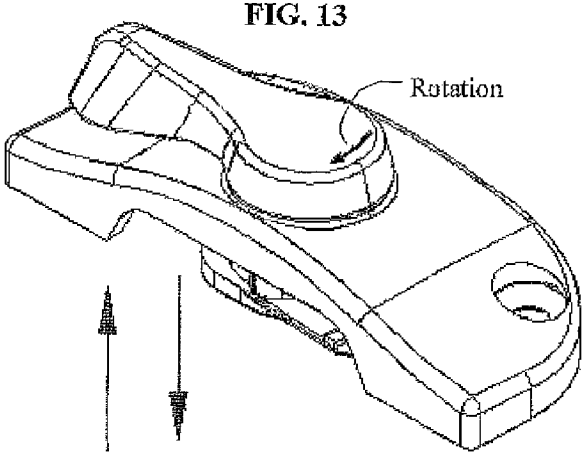
FIG. 13 is the assembled lock of FIG. 1 shown enlarged, and being with the shaft/handle and the locking cam-delay cam combination shown in the unlocked position.
Figure 14:
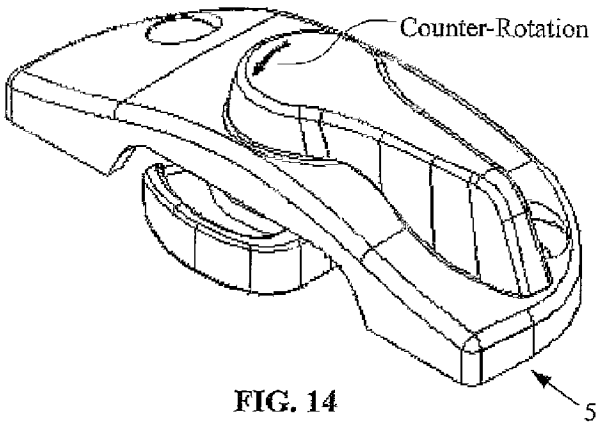
FIG. 14 is the assembled lock of FIG. 13, shown with the shaft/handle and the locking cam-delay cam combination in the locked position.
Figure 15:
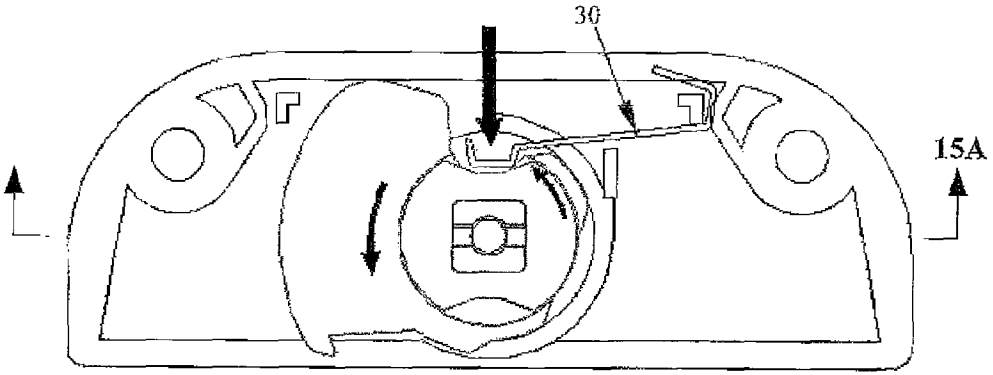
FIG. 15 is the bottom view of FIG. 10A enlarged.
Figure 15B:
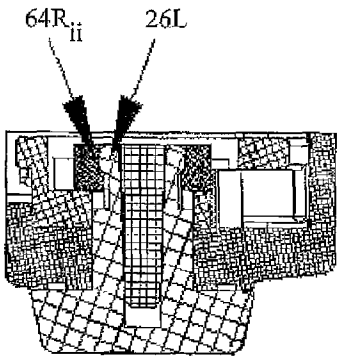
FIG. 15B is a cross-sectional view through the force entry resistance lock of FIG. 15, being taken along the short transverse direction.
Figure 15A:
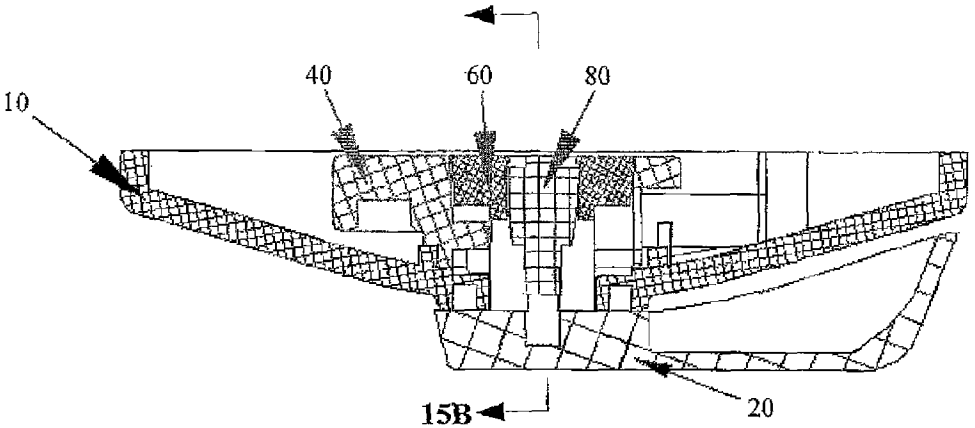
FIG. 15A is a cross-sectional view through the force entry resistance lock of FIG. 15, being taken along the long transverse direction.

The portion of the assembly sequence in FIGS. 8 and 8A are shown enlarged in FIGS. 12 and 12A, along with an enlargement of the perspective view of the locking cam being shown in FIG. 12B. These enlarged views permit identification of certain features that enable proper rotational engagement between the locking cam and the interior surface 12 of housing 10. While the top of the locking cam 40 is not visible in FIG. 12, it is exposed in FIG. 12B. The housing 10 may comprise, being concentric with orifice 15, telescoping bosses 13I, upon which the correspondingly formed telescoping cylinders 45 of the locking cam 40 may bear during rotation of the locking cam. In addition, protruding down from the interior surface 12 of housing 10 may be a first protrusion 16 that may serve as a travel limiting stop for the locking cam at both the cam's locked and unlocked positions. As the assembled locking cam and delay cam combination is shown positioned in FIG. 12 for installation into the housing cavity, it occupies the unlocked position. With reference to FIGS. 12, 12B, and 5A, it may be seen that with the assembled locking cam and delay cam combination being so installed in the housing, that the side surface 45$Ds_i$ of cylindrical protrusion 45$D_i$ will engage the side 16*u* of protrusion 16 and stop rotational travel of the locking cam upon reaching the unlocked position (FIGS. 13 and 13A). Similarly, it may be visualized that upon rotation of the combination to the locked position, as described more fully hereinafter following the complete assembly description, that the side surface 45$Ds_{ii}$ of cylindrical protrusion 45$D_{ii}$ will engage the side 16L of protrusion 16 and stop rotational travel of the locking cam 40 upon reaching the locked position (FIGS. 14 and 14A). A second protrusion 17 may also be used so that rotational travel is limited at two locations, being roughly 180 degrees apart.

Referring now to FIG. 9, it may be seen that the shaft 20 may next be installed. The shaft 20 may be rotatably/pivotally mounted to the housing 10, by orifice 15 of the housing receiving the cylinder 21 of the shaft, and with the cylinder 21 of the shaft 20 thereby also being rotatably received by the orifice 41 of the locking cam 40. This insertion of the shaft 20 also results in the rectangular protrusion 24 of the shaft (formed into prongs 26 and 27) being received within the rectangular opening 64 of the delay cam 60. The delay cam 60 may be fixedly secured to the shaft 20 by using screws, etc., or through the use of adhesive. The delay cam 60 may alternatively be secured to the shaft 20 by a lip on an end of at least one of the prongs, overhanging the delay cam. In one embodiment, each of the two prongs 26 and 27 may have a corresponding lip 26L and 27L (FIGS. 2 and 11B), and the delay cam 60 may have a first rectangular recess 64$R_i$ and a second rectangular recess 64$r_{ii}$ (FIGS. 5A and 11C-11D). During insertion of the shaft 20, the prongs 26L and 27L may elastically deflect inward towards each other until the lips 26L and 27L reach the recesses 64$R_{ii}$ and 64$r_{ii}$, where they may naturally spring back outward to their un-deflected or nearly-undeflected state to overhang the delay cam by engaging the recesses. To prevent inadvertent inward deflection of the prongs after being so installed, a wedge 80 may be driven into the opening 25 of shaft 20 (FIGS. 10 and 11-11B). The wedge member 80 may be formed using a wedge shape 81 (FIG. 1), at the center of which may be a conical spike 82 that may further serve to cause separation of the prongs 26 and 27. Other alternative shapes available for the wedge member 80 are shown within FIGS. 29A through 29F. The wedge member 80 may be positively retained within the opening 25 of the shaft by two tabs 64T being formed within the rectangular opening 64 of delay cam 60. The wedge may be inserted or pressed passed the tabs in an interference fit, so that once beyond the tabs, as seen in the enlarged view in FIG. 11A, the tabs may thereafter serve to positively retain the wedge within opening 25.

The actual movement of the cams and selective engagement therebetween, with the coordinated biasing of the locking spring for locking and/or detent securing of the cams, may be as follows.

Figure 16A:
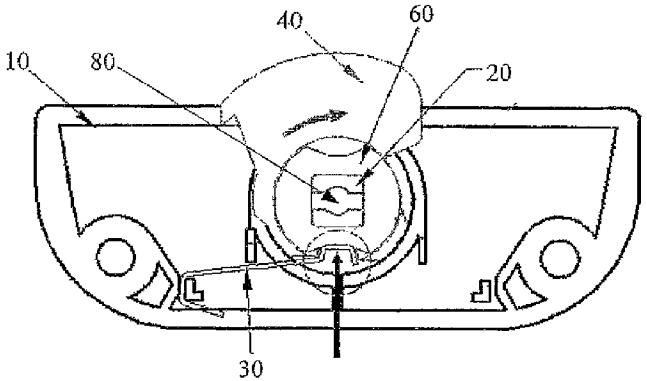
FIGS. 16A-16D show the sequence of movements of the delay cam, the locking cam, the spring member, and the shaft with graspable handle, in moving from the locked position to the unlocked position.
Figure 16B:
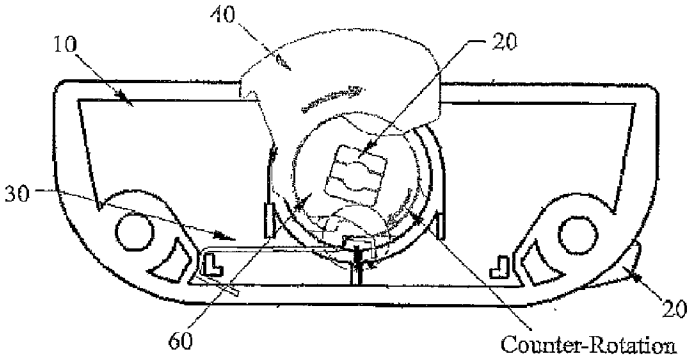

With the lock (5, 6, or 7) in the locked position (FIGS. 16A and 18-18A), the first leg 36, connector 37, and second leg 38 of the second end 32 of the locking spring 30 are nested within the first opening 46 of the locking cam, such that the first leg 36 may contact or be in close proximity to the side 46S1 of the opening 46, and the second leg 38 may contact or be in close proximity to the side 46S2 of the opening 46. The second leg 38 contacting side 46S2 of the opening 46 may thereby serve to inhibit forced counter-rotation of the locking cam. It should be noted that herein, the term "rotation" is generally intended herein to describe the clock-wise revolution of the shaft/handle and cams to cause movement from the unlocked to the locked position, as seen from a view looking down on the lock (see FIG. 13), while the term "counter-rotation" is used to conversely describe counter-clockwise revolution of the shaft/handle and cams to cause movement from the locked to the unlocked position, as seen in FIG. 14.

Figure 18A:
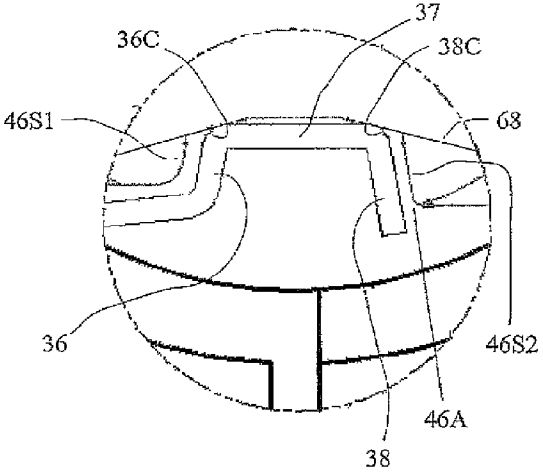
FIG. 18A is an enlarged detail view of the lock of FIG. 18.

The locking cam 40 is therefore positively locked itself, in addition to locking the window sash, when it occupies the second position, as it is intended with the present invention that the lock remain locked until deliberately actuated using the shaft/handle from the building's interior, thereby preventing any attempt at using a lock picking device to gain unwanted entry. The delay cam 60 may also be detent secured at the locked position, as the second end of the locking spring 30 may also be releasably engaging the first chamfered recess 68 of the delay cam, because of the length of the legs 36 and 38 of the locking spring 30 (FIG. 18A).

This engagement with the recess 68 of the delay cam 60 is significant in the operation and sequencing of the respective rotation/counter-rotation of the cams, as will be discussed next. Therefore, to successfully practice the invention, in manufacturing the locking cam 40 and locking spring 30, it is necessary to carefully calibrate the depth of penetration (length) of the locking spring legs 36 and 38, with the thickness of the locking cam 40 wall (the thickness of the cylinder wall formed by the outer diameter of cylinder 45 and the inner diameter of orifice 48), as well as the angle between the locking spring legs, if a slight trapezoidal shape is used instead of a square shape (parallel legs).

Figure 18:
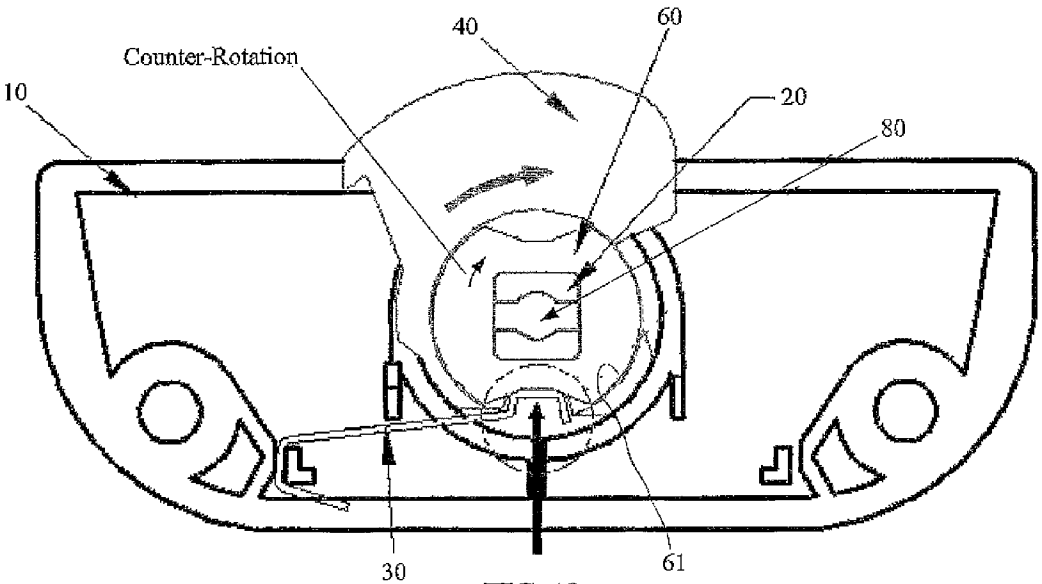
FIG. 18 is the view of FIG. 16A enlarged.
Figure 19:
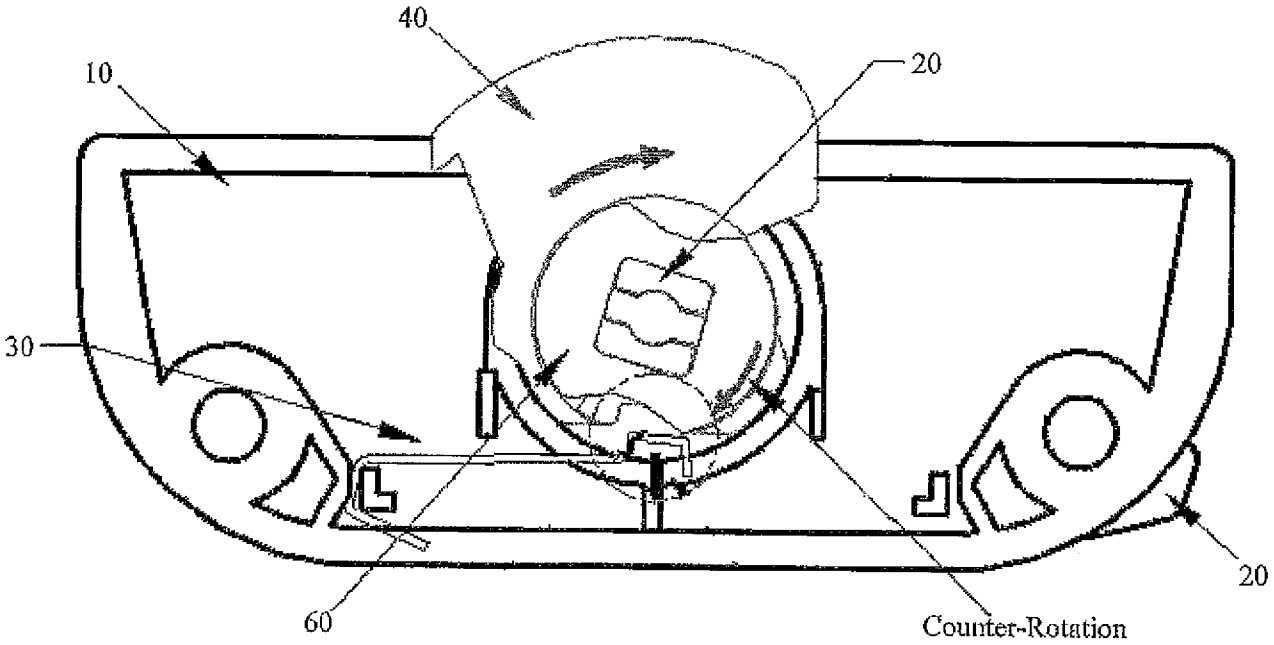
FIG. 19 is the view of FIG. 16B enlarged.
Figure 20:
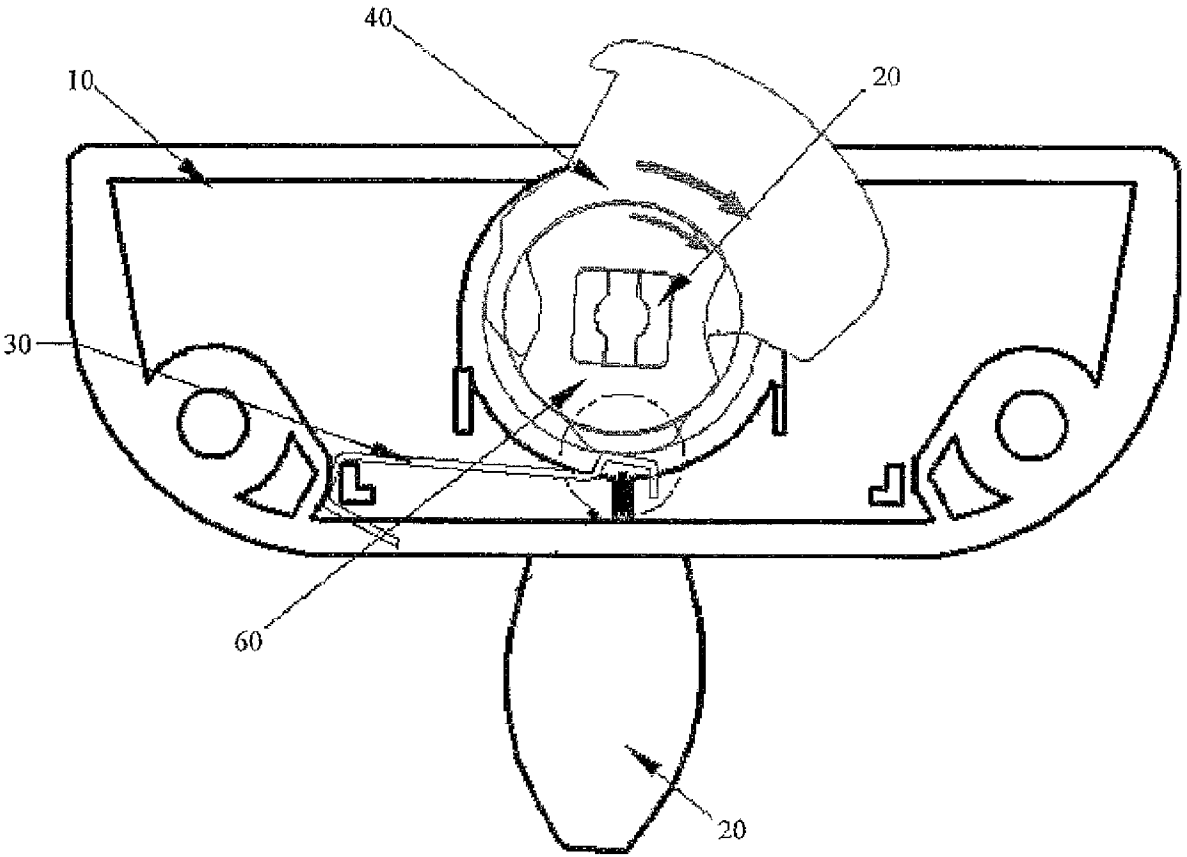
FIG. 20 is the view of FIG. 16C enlarged.

To unlock the lock, seen by the sequence in FIGS. 16A-16D (and 18-21), the handle 23 of shaft 20 may be counter-rotated, which causes corresponding counter-rotation of the delay cam 60, since they are mechanically connected as previously described. As seen in FIGS. 18 and 18A, counter-rotation of the delay cam 60 results in the angled side of the first V-shaped recess 68 of the delay cam 60 contacting the transition 38C between second leg 38 and connector 37 of the locking spring 30, resulting in the delay cam 60 countering the bias of the locking spring 30, to back off the spring until the connector 37 is then biased into contact with cylinder 61 of the delay cam (see FIG. 19). This change to (deformation of) the locking spring (with its biasing being countered) may generally be seen by comparing the spring's appearance in FIGS. 16C and 16D.

With the spring so positioned and biased into contact with cylinder 61, the chamfered transition 38C between second leg 38 and connector 37 of the locking spring 30 may nonetheless still be contacting the edge 46A of the locking cam 40 (FIGS. 18A and 19), which is formed where the side 46S1 of the opening meets the periphery of the cylinder 45. Such contact may require a minimal clearance, locally, between the cylinder 61 of the delay cam 60, and the orifice 48 of the locking cam 40. This minimal contact may serve as a detent to releasably restrain the locking cam from potential counter-rotation due to frictional contact with the delay cam.

Figure 16D:
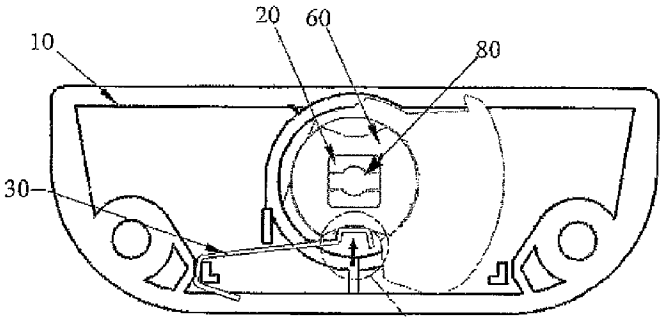
Figure 16C:
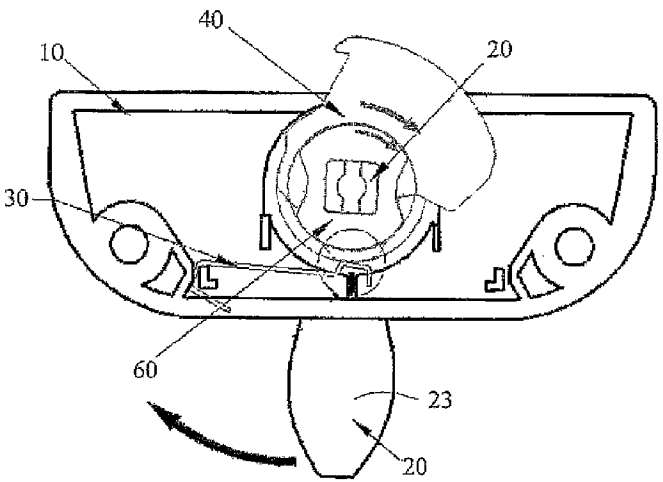
Figure 17B:
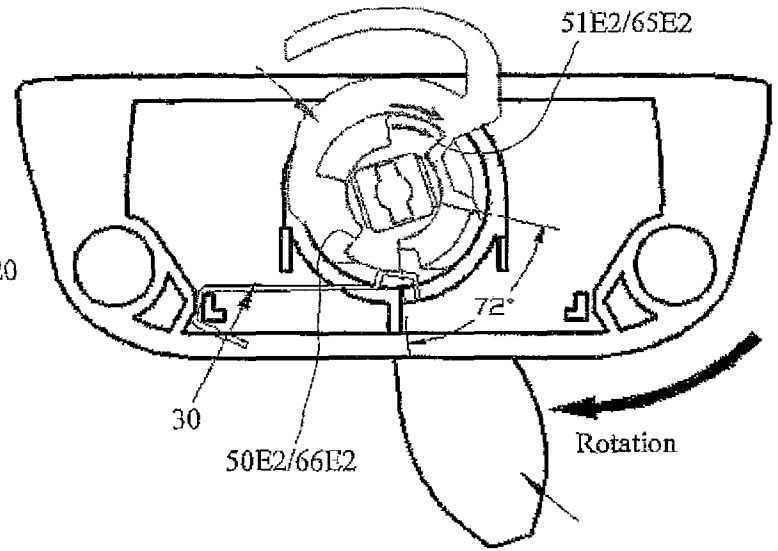
FIG. 17B is the cross-sectional view of FIG. 17A, but with the delay cam having been rotated approximately 72 degrees.
Figure 17A:
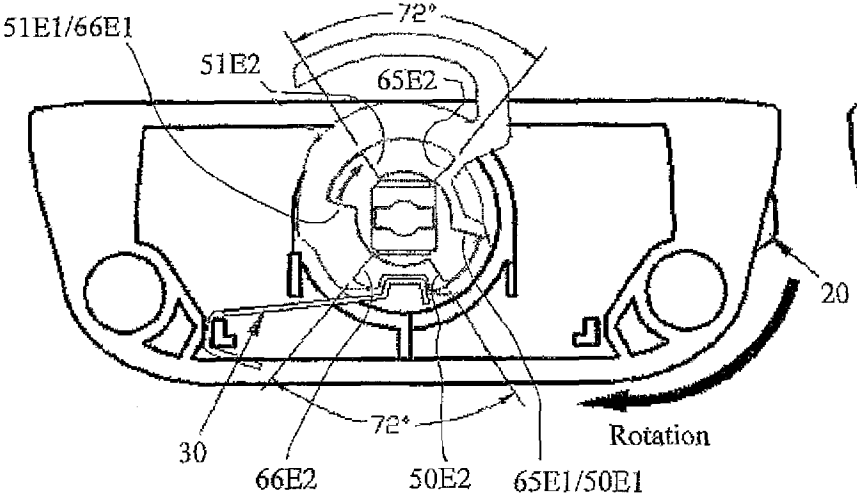
FIG. 17A is a cross-sectional view through the lock of FIG. 1, but with the lock being in the locked position, and being taking at the same plane as FIG. 6E (showing delay cam protrusions engaging locking cam protrusions).
Figure 21:
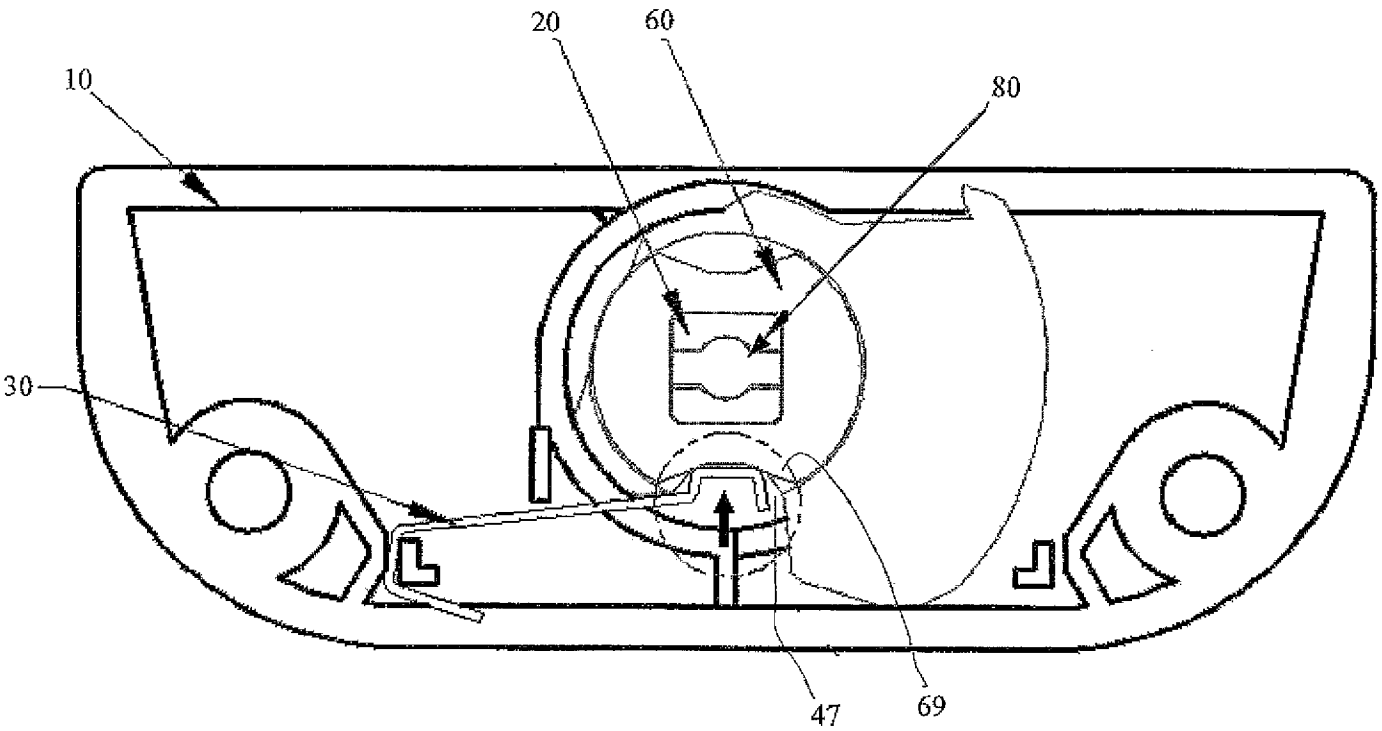
FIG. 21 is the view of FIG. 16D enlarged.
Figure 22A:
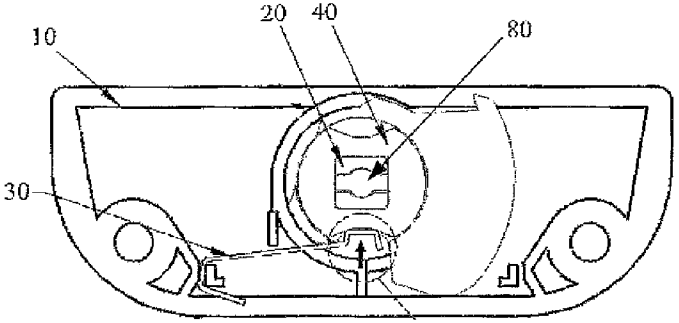
FIGS. 22A-22D show the sequence of movements of the delay cam, the locking cam, the spring member, and the shaft with graspable handle, in moving from the unlocked position to the locked position.
Figure 22B:
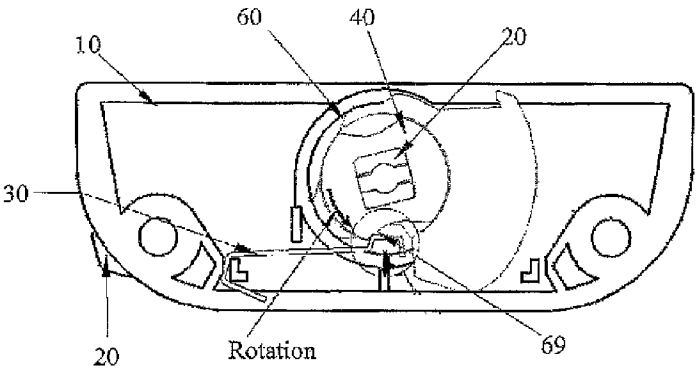
Figure 22D:
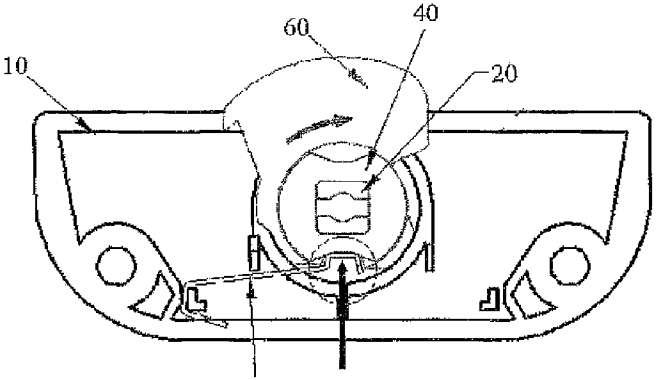
Figure 22C:
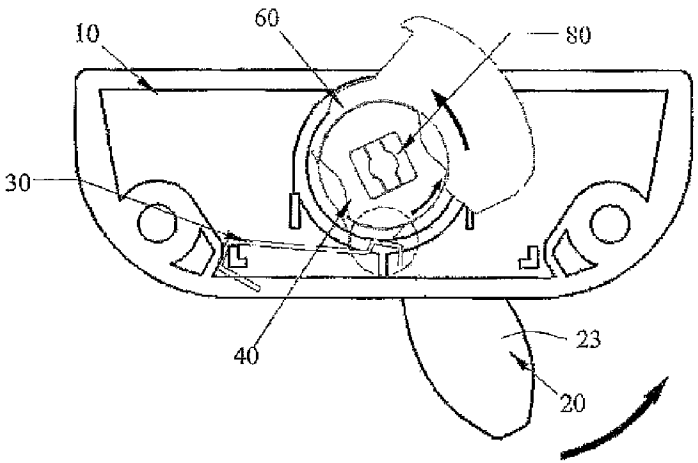
Figure 23:
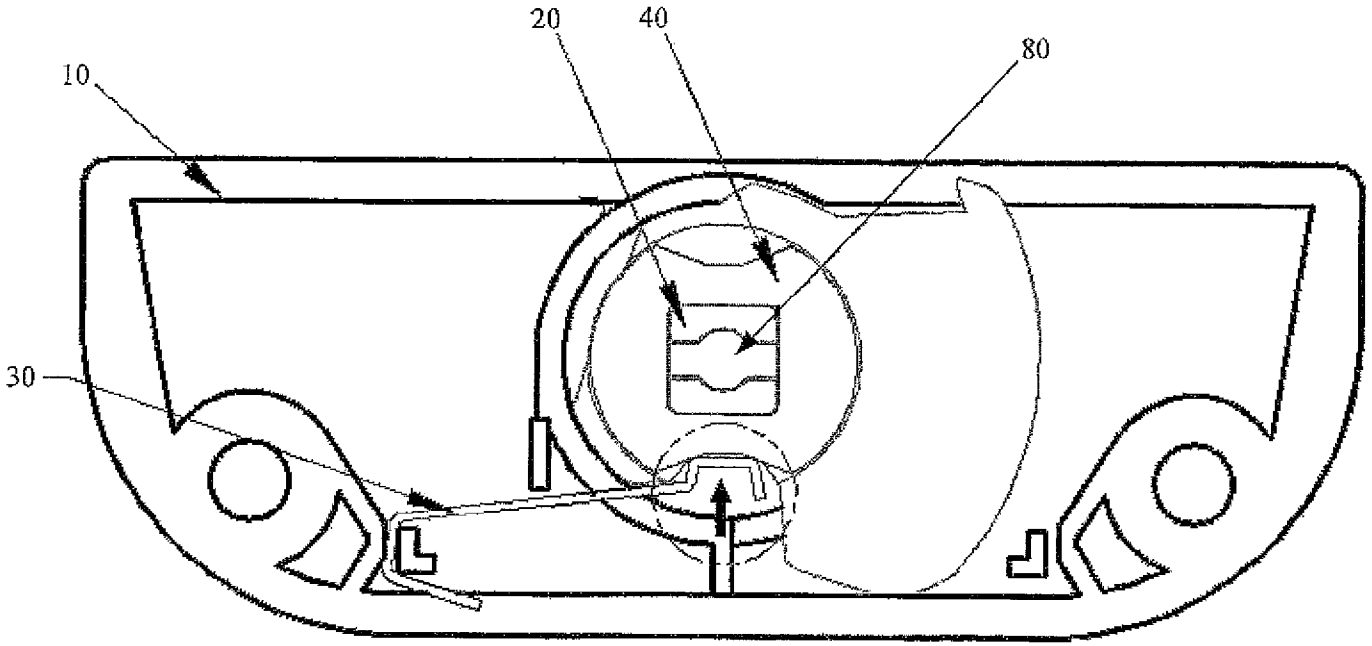
FIG. 23 is the view of FIG. 22A enlarged.
Figure 24:
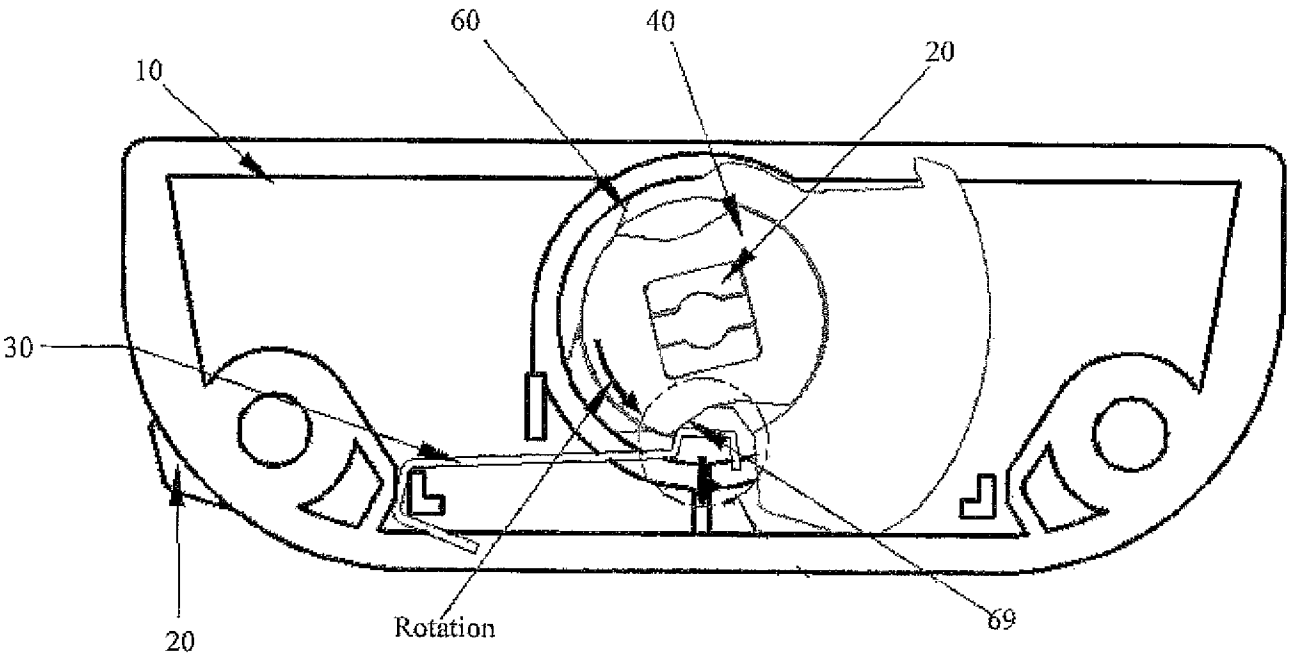
FIG. 24 is the view of FIG. 22B enlarged.
Figure 25:
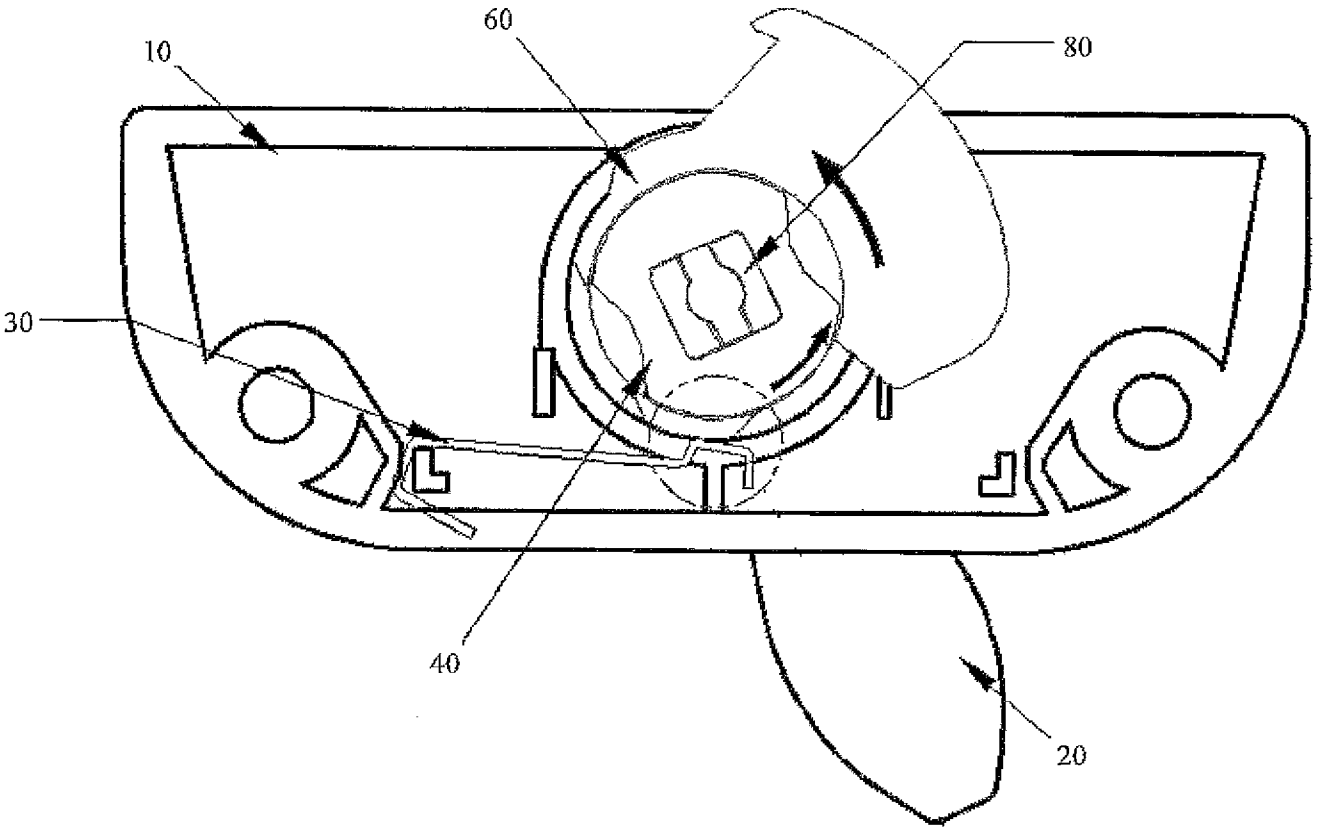
FIG. 25 is the view of FIG. 22C enlarged.
Figure 26:
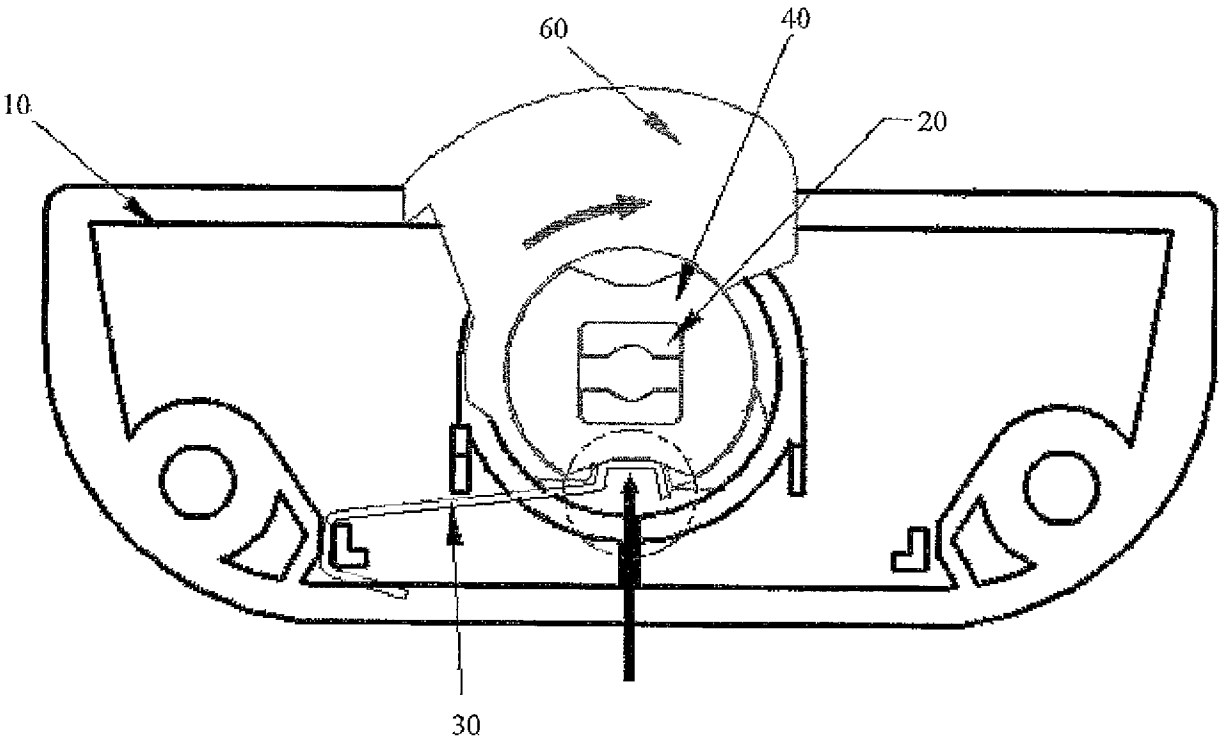
FIG. 26 is the view of FIG. 22D enlarged.
Figures 27A, 27B, 27C, 27D:
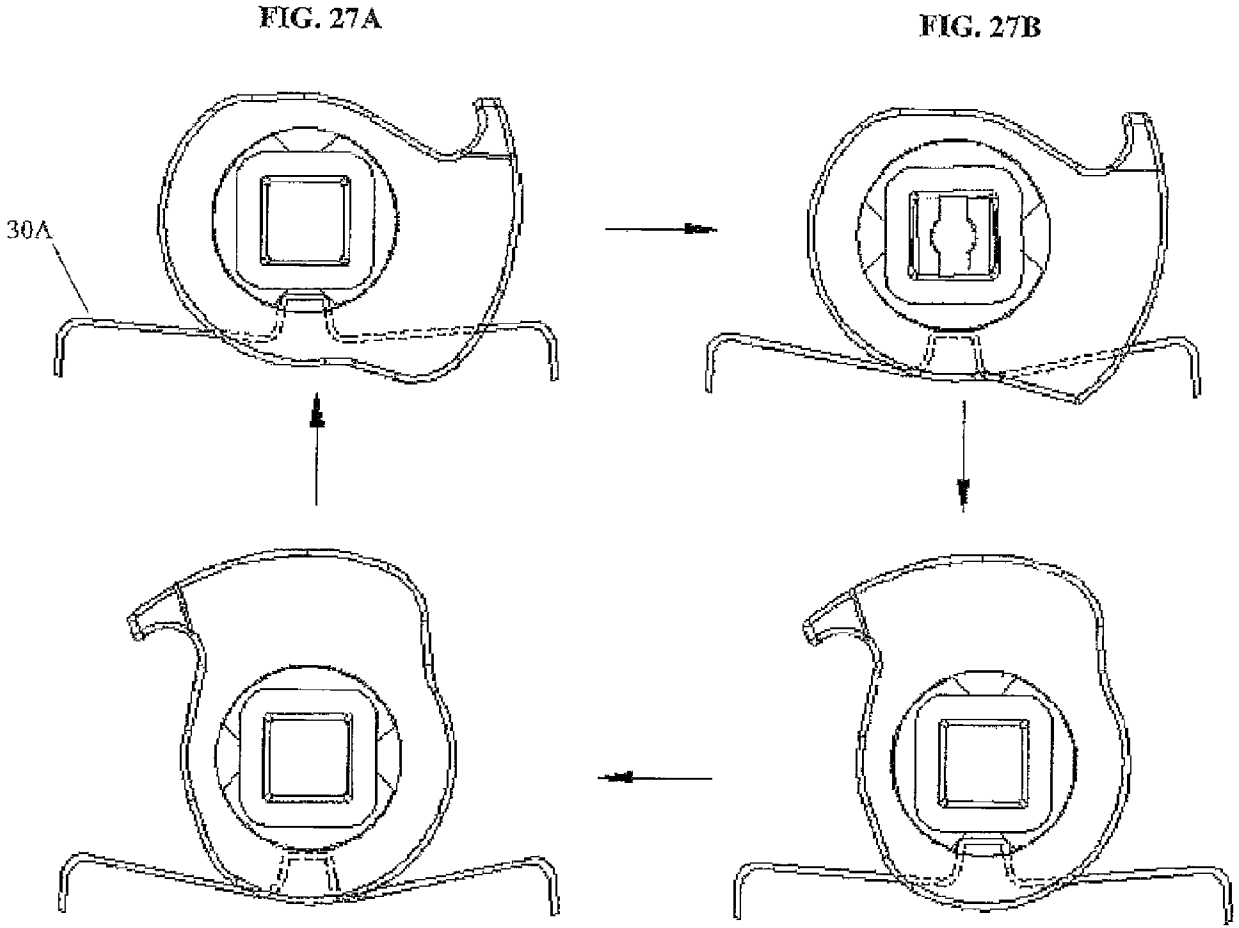
FIGS. 27A-27D shows use of an alternate embodiment of locking spring member that may be secured to the housing in two locations, and thus not be cantilevered.
Figure 28B:
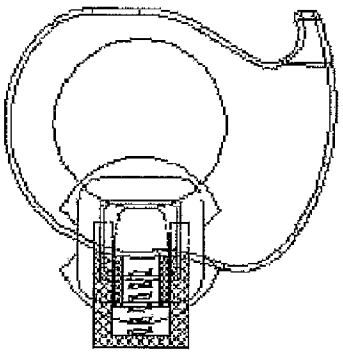
FIG. 28A-28D shows a spring-loaded stop member usable as an alternative to the locking spring.
Figure 28C:
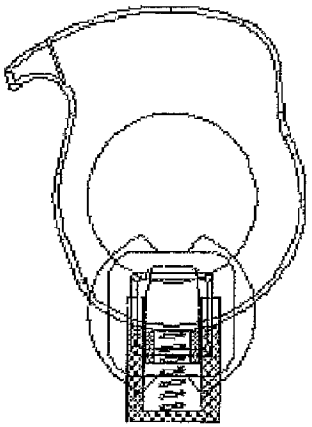
Figure 28A:
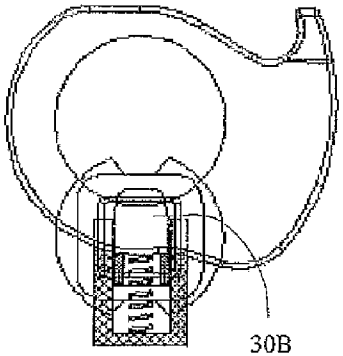
Figure 28D:
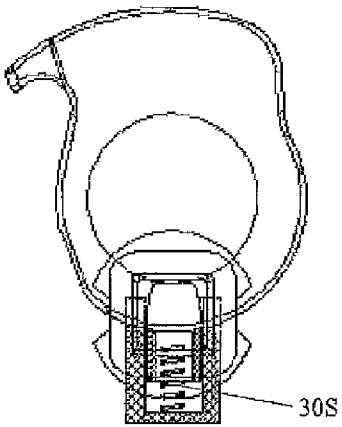

Once the handle 23 of shaft 20 is counter-rotated approximately 72 degrees, as seen in the rotational movement between the lock of FIG. 17A and the lock of FIG. 17B, engagement surfaces 51E2 and 50E2 of the locking cam 40 will then engage the engagement surfaces 65E2 and 66E2 of protrusions 65 and 66 of delay cam 60, respectively, and as such, continued counter-rotation of the shaft/handle and delay cam will thereafter cause driven counter-rotation of the locking cam 40. As the delay cam 60 begins to cause this driven counter-rotation of the locking cam, the chamfered transition 38C of the locking spring contacting the edge 46A of the locking cam 40 serves to counter the bias of the locking spring 30 to back off the spring even further until the connector 37 is then biased into contact with the locking cam cylinder 45. Further counter-rotation of the shaft/handle and delay cam will result in driven counter-rotation of the locking cam for approximately 90-108 degrees, which will place the lock in the unlocked position, as seen in FIG. 16D and FIG. 21. Total rotation/counter-rotation of the handle 23 of shaft 20 between the locked and unlocked positions may, but need not necessarily be, approximately 180 degrees. Also, total rotation/counter-rotation of the locking cam between the retracted and extended positions, because of the sizing and positioning of the protrusions 65 and 66 on the delay cam and the protrusions 50 and 51 on the locking cam, may, but need necessarily be, approximately 90 degrees.

Upon reaching the unlocked position (FIG. 21), the retracted locking cam 40 may be detent secured by the trapezoidal shaped second opening 47 therein releasably receiving the second end 32 of the locking spring 30. The delay cam 60 may also be detent secured by the second V-shaped recess 69 then being clocked to be aligned with the locking cam second opening 47, where it may also releasably receive the legs 36, 37, and 38 of the locking spring 30. It should be pointed out that because of the V-shape of recess 69 in delay cam 60, initial engagement therein by the locking spring 30 may cause the delay cam and shaft to be driven by the spring during its final moments of rotation/counter-rotation, in advance of being driven by the shaft due to the user turning the handle. Similarly, because of the trapezoidal shape recess 47 in the locking cam 40, it may also be driven by the spring to "snap" into the lock/unlocked detent position prior to the user causing complete rotation/counter-rotation for the full 180 degrees of handle motion.

Rotation of the handle 23 of shaft 20 to conversely place the lock into the locked condition from the unlocked condition proceeds in the opposite sequence (FIGS. 22A-22D, and as enlarged in FIGS. 23-26). Delay cam rotation resulting from rotation of the handle from the first position to the second position will result in the delay cam selectively engaging and driving the locking cam. Initially, a first portion of the rotation of the delay cam (approximately 72 degrees) will be without driven rotation of the locking cam, but a second portion of the rotation of the delay cam will, upon engagement surfaces 65E1 and 66E1 of protrusions 65 and 66 of delay cam 60 respectively engaging the engagement surfaces 51E1 and 50E1 of the locking cam 40, cause driven rotation of the locking cam to thereby drive the locking cam from the retracted position into the extended position, being with a portion of the locking cam protruding out from the housing cavity.

The examples and descriptions provided merely illustrate a preferred embodiment of the present invention. Those skilled in the art and having the benefit of the present disclosure will appreciate that further embodiments may be implemented with various changes within the scope of the present invention. Other modifications, substitutions, omissions and changes may be made in the design, size, materials used or proportions, operating conditions, assembly sequence, or arrangement or positioning of elements and members of the preferred embodiment without departing from the spirit of this invention.

We claim:

1. A window latch, for use in releasably securing at least one sliding sash window relative to a window frame wherein a portion of said latch engages a keeper located on the window frame or located on a second sash member, said latch comprising:

a housing, said housing comprising a cavity and an orifice extending into said cavity;

a shaft, said shaft being rotatably mounted in said housing orifice, with a portion of said shaft protruding into said housing cavity and a portion protruding out from said housing;

a locking cam, said locking cam comprising an orifice, said locking cam being rotatably mounted upon said shaft within said housing cavity, with said orifice of said locking cam being rotatably received upon said shaft;

a delay cam, said delay cam being fixedly mounted to said shaft within said housing cavity, with a cylindrical portion of said delay cam being received within a second orifice of said locking cam, and with one or more engagement surfaces of said delay cam being positioned to selectively engage said locking cam;

a locking spring, a portion of said locking spring being secured to said housing within said cavity, with a second portion of said locking spring being biased into contact with said locking cam;

wherein said shaft causes said delay cam to move between a first position and a second position to selectively drive said locking cam between a latch-unlocked position and a latch-locked position, said second portion of said biased locking spring configured to engage within a first opening in said locking cam to lock said locking cam relative to said housing upon said locking cam reaching said latch-locked position; and wherein said engagement of said second portion of said locking spring in said first opening of said locking cam is to a depth to further permit engagement of said second portion of said locking spring therein with a first recess in said cylindrical portion of said delay cam received within said locking cam, to thereby serve as a detent to releasably retain said delay cam in said second position.

2. The window latch according to claim 1, wherein said shaft causing said delay cam to selectively engage and drive said locking cam between said latch-unlocked position and said latch-locked position comprises rotation of said shaft causing corresponding rotation of said delay cam, with:

a first portion of said corresponding rotation of said delay cam being without driven rotation of said locking cam; and a second portion of said corresponding rotation of said delay cam causing driven rotation of said locking cam to thereby drive said locking cam from said latch-unlocked position where said locking cam is retracted within said housing, into said latch-locked position where a portion of said locking cam protrudes out of an opening in said housing cavity.

3. The window latch according to claim 2, wherein said second portion of said rotation of said delay cam causing driven rotation of said locking cam is by a first engagement surface on said delay cam being positioned thereon to engage a corresponding first engagement surface on said locking cam after said first portion of said delay cam rotation.

4. The window latch according to claim 3, wherein said first portion of said rotation of said delay cam comprises approximately 72 degrees to 90 degrees of rotation.

5. The window latch according to claim 4, wherein said first and second portions of said rotation of said delay cam comprises approximately 180 degrees of rotation; and wherein said locking cam rotation between said latch-unlocked and said latch-locked position comprises approximately 90 degrees of rotation.

6. The window latch according to claim 5, wherein said shaft causing said delay cam to selectively engage and drive said locking cam between said latch-unlocked position and said latch-locked position further comprises counter-rotation of said shaft causing corresponding counter-rotation of said delay cam, with:

a first portion of said corresponding counter-rotation of said delay cam being without driven counter-rotation of said locking cam; and a second portion of said corresponding counter-rotation of said delay cam causing driven counter-rotation of said locking cam to thereby drive said locking cam from said latch-locked position into said latch-unlocked position.

7. The window latch according to claim 6, wherein said first recess in said delay cam comprises a first V-shaped recess; and wherein said first portion of said corresponding delay cam counter-rotation causes partial disengagement of said second portion of said locking spring from said first opening in said locking cam, by one side of said first V-shaped recess in said delay cam driving said second portion of said locking spring to back out from said first V-shaped recess to thereafter leave an angled surface of said locking spring remaining engaged with an outer portion of said locking cam first opening to serve as a detent.

8. The window latch according to claim 7, wherein said second portion of said counter-rotation of said delay cam causing driven counter-rotation of said locking cam is by a second engagement surface on said delay cam being positioned to engage a corresponding second engagement surface on said locking cam; said driven counter-rotation of said locking cam causing complete disengagement of said angled surface of said locking spring from said outer portion of said locking cam first opening.

9. The window latch according to claim 8, wherein said first portion of said corresponding counter-rotation of said delay cam comprises approximately 72 degrees to 90 degrees of counter-rotation; and wherein said first and second portions of said corresponding counter-rotation of said delay cam comprise approximately 180 degrees of counter-rotation.

10. The window latch according to claim 9, wherein said locking cam further comprises a second opening to form a second locking cam detent; and wherein when said locking cam is driven into said latch-unlocked position, said second portion of said locking spring engages said second opening in said locking cam, said second opening comprising a trapezoidal shape to permit said second portion of said locking spring to be releasable therefrom during said second portion of said corresponding rotation of said delay cam.

11. The window latch according to claim 10, wherein said delay cam further comprises a second V-shaped recess in said portion of said delay cam received within said locking cam to thereby serve as a second delay cam detent; and wherein when said locking cam is driven into said latch-unlocked position, said second portion of said locking spring engages said second opening in said locking cam to a depth to further permit engagement of said second portion of said locking spring therein with said second V-shaped recess.

12. The window latch according to claim 11, wherein said delay cam being fixedly mounted to said shaft comprises a rectangular protrusion on said shaft having an opening therein to create a pair of prongs, said rectangular protrusion being received in a corresponding rectangular opening in said delay cam and being secured therein by a wedge-shaped member being driven between said prongs to cause a lip on an end of at least one of said prongs to overhang a portion of said delay cam.

13. The window latch according to claim 12, wherein said wedge-shaped member remains in said driven position between said prongs by said wedge being pressed past one or more tabs protruding into said rectangular opening, said one or more tabs thereafter retaining said wedge between said prongs.

14. The window latch according to claim 13, wherein said wedge-shaped member is from the group of wedge-shaped members consisting of: a V-shape, a conical prong shape, a conical cruciform.

15. The window latch according to claim 14, wherein said shaft comprises one or more concentrically formed cylinders of different diameters.

16. The window latch according to claim 15, wherein a graspable handle is mechanically secured to, or integrally formed with, said portion of said shaft protruding out from said housing.

17. The window latch according to claim 16, wherein said portion of said locking cam protruding out from said opening in said housing cavity in said latch-unlocked position comprises a slot therein, said slot being engageable with a key on a keeper.

18. The window latch according to claim 17, wherein said first opening in said locking cam comprises a shaped opening from the group of shaped openings consisting of: a rectangular-shaped opening, a square-shaped opening, and a trapezoidal-shaped opening.

19. A window latch comprising:

a housing, said housing comprising a cavity and an orifice extending into said cavity;

a shaft, said shaft being rotatably mounted in said housing orifice, with a portion of said shaft protruding into said housing cavity;

a locking cam, said locking cam comprising an orifice, said locking cam being rotatably mounted upon said shaft within said housing cavity, with said orifice of said locking cam being rotatably received upon said shaft;

a delay cam, said delay cam being fixedly mounted to said shaft within said housing cavity, with a cylindrical portion of said delay cam being received within a second orifice of said locking cam, and with one or more engagement surfaces of said delay cam being positioned to selectively engage said locking cam;

a locking spring, a portion of said locking spring being secured to said housing within said cavity, with a second portion of said locking spring being biased into contact with said locking cam;

wherein said shaft causes said delay cam to move between a first position and a second position to selectively drive said locking cam between a latch-unlocked position and a latch-locked position, said second portion of said locking spring configured to engage within a first opening in said locking cam to lock said locking cam relative to said housing upon said locking cam reaching said latch-locked position; and wherein said engagement of said second portion of said locking spring in said first opening of said locking cam is to a depth to further permit engagement of said second portion of said locking spring therein with a first recess in said cylindrical portion of said delay cam received within said locking cam, to thereby serve as a detent to releasably retain said delay cam in said second position.

20. The window latch according to claim 19, wherein said shaft causing said delay cam to selectively engage and drive said locking cam between said latch-unlocked position and said latch-locked position comprises rotation of said shaft causing corresponding rotation of said delay cam, with:

a first portion of said corresponding rotation of said delay cam being without driven rotation of said locking cam; and a second portion of said corresponding rotation of said delay cam causing driven rotation of said locking cam to thereby drive said locking cam from said latch-unlocked position where said locking cam is retracted within said housing, into said latch-locked position where a portion of said locking cam protrudes out of an opening in said housing cavity; and wherein said second portion of said rotation of said delay cam causing driven rotation of said locking cam is by a first engagement surface on said delay cam being positioned thereon to engage a corresponding first engagement surface on said locking cam, after said first portion of said delay cam rotation.

21. The window latch according to claim 20, wherein said shaft causing said delay cam to selectively engage and drive said locking cam between said latch-unlocked position and said latch-locked position further comprises counter-rotation of said shaft causing corresponding counter-rotation of said delay cam, with:

a first portion of said corresponding counter-rotation of said delay cam being without driven counter-rotation of said locking cam; and a second portion of said corresponding counter-rotation of said delay cam causing driven counter-rotation of said locking cam to thereby drive said locking cam from said latch-locked position into said latch-unlocked position; and wherein said second portion of said counter-rotation of said delay cam causing driven counter-rotation of said locking cam is by a second engagement surface on said delay cam being positioned to engage a corresponding second engagement surface on said locking cam; said driven counter-rotation of said locking cam causing complete disengagement of said angled surface of said locking spring from said outer portion of said locking cam first opening.

22. The window latch according to claim 21, wherein said first recess in said delay cam comprises a first V-shaped recess; and wherein said first portion of said corresponding delay cam counter-rotation causes partial disengagement of said second portion of said locking spring from said first opening in said locking cam, by one side of said first V-shaped recess in said delay cam driving said second portion of said locking spring to back out from said first V-shaped recess to thereafter leave an angled surface of said locking spring remaining engaged with an outer portion of said locking cam first opening to serve as a detent.

* * * * *